US009469494B2

(12) United States Patent
Cederholm et al.

(10) Patent No.: US 9,469,494 B2
(45) Date of Patent: Oct. 18, 2016

(54) APPARATUS AND METHODS FOR FORMING A BUTT SPLICE ON A RUNNING WEB

(71) Applicants: Roger Cederholm, South Beloit, IL (US); Jordan Martin, Rockford, IL (US)

(72) Inventors: Roger Cederholm, South Beloit, IL (US); Jordan Martin, Rockford, IL (US)

(73) Assignee: Martin Automatic, Inc., Rockford, IL (US)

( * ) Notice: Subject to any disclaimer, the term of this patent is extended or adjusted under 35 U.S.C. 154(b) by 0 days.

(21) Appl. No.: 14/199,652

(22) Filed: Mar. 6, 2014

(65) Prior Publication Data

US 2014/0251528 A1 Sep. 11, 2014

Related U.S. Application Data

(60) Provisional application No. 61/773,913, filed on Mar. 7, 2013.

(51) Int. Cl.
*B65H 19/18* (2006.01)

(52) U.S. Cl.
CPC ..... *B65H 19/1873* (2013.01); *B65H 19/1852* (2013.01); *B65H 2301/4622* (2013.01); *B65H 2301/4623* (2013.01); *B65H 2301/4633* (2013.01); *B65H 2301/46412* (2013.01); *B65H 2408/217* (2013.01); *B65H 2701/176* (2013.01); *B65H 2701/177* (2013.01); *B65H 2701/1742* (2013.01)

(58) Field of Classification Search
CPC ..... B65H 2301/4622; B65H 2301/4623; B65H 2301/4633
See application file for complete search history.

(56) References Cited

U.S. PATENT DOCUMENTS

| | | | | |
|---|---|---|---|---|
| 3,957,567 | A * | 5/1976 | Pursell | B29C 65/5042 156/159 |
| 4,120,739 | A * | 10/1978 | Peeters et al. | 156/506 |
| 4,190,483 | A * | 2/1980 | Ryan et al. | 156/504 |
| 6,676,062 | B1 * | 1/2004 | Herhaus | 242/417 |
| 6,792,987 | B2 * | 9/2004 | Monroe | 156/351 |
| 2002/0189764 | A1 * | 12/2002 | Keene | B31F 5/06 156/353 |
| 2010/0215963 | A1 * | 8/2010 | Matsuo | 428/411.1 |
| 2012/0234469 | A1 * | 9/2012 | Okabe | 156/157 |

FOREIGN PATENT DOCUMENTS

| | | | |
|---|---|---|---|
| EP | 1528022 | A1 * | 5/2005 |
| EP | 2402272 | A2 * | 1/2012 |

* cited by examiner

*Primary Examiner* — Mark A Osele
(74) *Attorney, Agent, or Firm* — Schiff Hardin LLP

(57) ABSTRACT

Methods are provided for forming a butt splice to join a first web of material to a second web of material is provided. The first web of material is cut or trimmed to form a first edge. The second web of material is cut or trimmed to form a second edge, and the second edge is positioned with respect to and registered with the first edge to define a gap therebetween. A curable liquid adhesive, such as an ultraviolet (UV)-curable liquid adhesive, is dispensed or applied within the gap, and the liquid adhesive is cured to form the butt splice that joins or splices the first web of material to the second web of material.

24 Claims, 15 Drawing Sheets

135
120
134
110
41
140
104
40
30
132
130
102
122
124
116
118
126
128
10

APPARATUS AND METHODS FOR FORMING A BUTT SPLICE ON A RUNNING WEB

CROSS-REFERENCE TO RELATED APPLICATION

This application claims priority to U.S. Provisional Application Ser. No. 61/773,913 filed Mar. 7, 2013, the entire disclosure of which is hereby incorporated by reference herein.

BACKGROUND

The subject matter disclosed herein relates generally to joining together a leading edge of a newly prepared web from a new roll of material to a trailing edge of a web from an expiring roll of material that is being fed to a continuous web processing operation and, more particularly, to an apparatus and methods for forming a butt splice to join the webs using a UV-cured liquid adhesive applied within a gap formed between the leading edge of the web from the new roll of material and the trailing edge of the web from the expiring roll of material.

Various apparatus and methods for joining or splicing webs used in continuous web processing operations are known in the art. One common method of joining web materials is a lap splice, wherein a leading edge of a new web is treated with a suitable adhesive, and at a proper time is manually lapped over a trailing edge of an expiring roll. U.S. Pat. No. 4,519,858 describes an apparatus and method for making such lap splices. Drawbacks to the lap splice include an undesirable double thickness of material at the splice, which is particularly unsuitable for relatively thick web materials. Further, because of restrictive operations downstream of the splice, certain types of materials, including two-ply pressure sensitive label stock, cannot be spliced in a lap splice.

Another common method of joining webs is through the use of a butt splice. With a butt splice, the leading edge of the new roll is butted up against, but does not overlap, the trailing edge of the expiring roll. A relatively thin, single-sided piece of adhesive tape is then used to join the butted ends together. In the past, hand operations have had to be used to achieve a good-quality butt splice. Typically, a good quality butt splice has less than a one/one thirty-second inch gap between the butted ends of the webs that are being joined. The accuracy required has necessitated the stoppage of the running web from the expiring roll for a sufficient time to make a hand splice. However, as each roll expires, such stoppage results in significant loss of production time. More recently, automated machines and methods have been developed to quickly and accurately join webs through the use of an adhesive tape to form the butt splice. See, for example, U.S. Pat. No. 7,022,205. However, in some conventional butt splicing machines and methods, the adhesive tape undesirably increases a thickness of the splice. Moreover, the adhesive tape may not adequately adhere to certain web materials, such as web materials coated with grease-proof, water-proof, or vapor deposition coatings, for example.

SUMMARY

In one aspect, an apparatus and methods for forming a butt splice to join a first web of material to a second web of material is provided. The first web of material is cut or trimmed to form a first edge. The second web of material is cut or trimmed to form a second edge, and the second edge is positioned with respect to and registered with the first edge to define a gap therebetween. A curable liquid adhesive, such as an ultraviolet (UV)-curable liquid adhesive, is dispensed or applied within the gap, and the liquid adhesive is cured to form the butt splice that joins or splices the first web of material to the second web of material.

DETAILED DESCRIPTION

Figure 1:
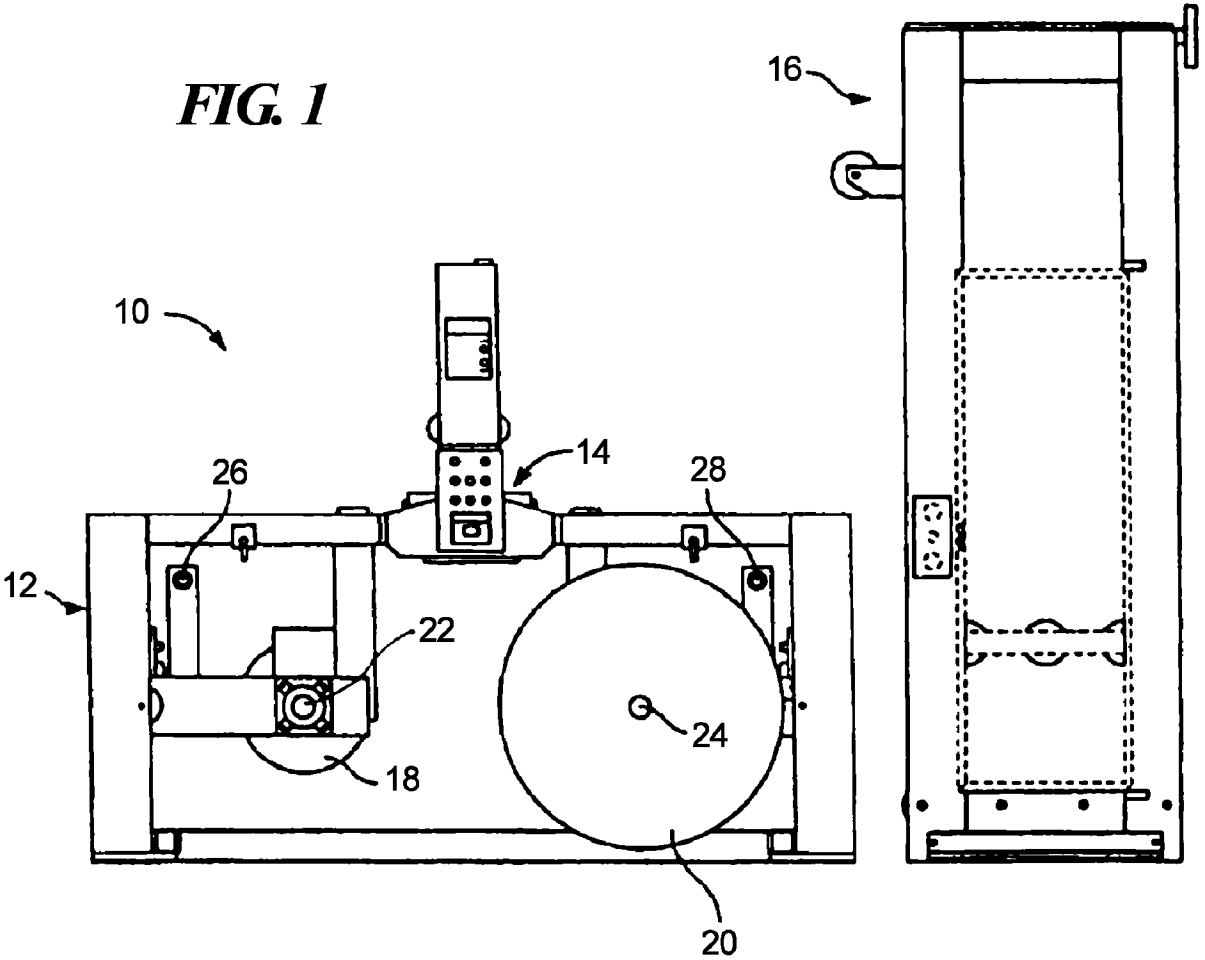
FIG. 1 is a side elevational view of an exemplary web splicer.
Figure 2:
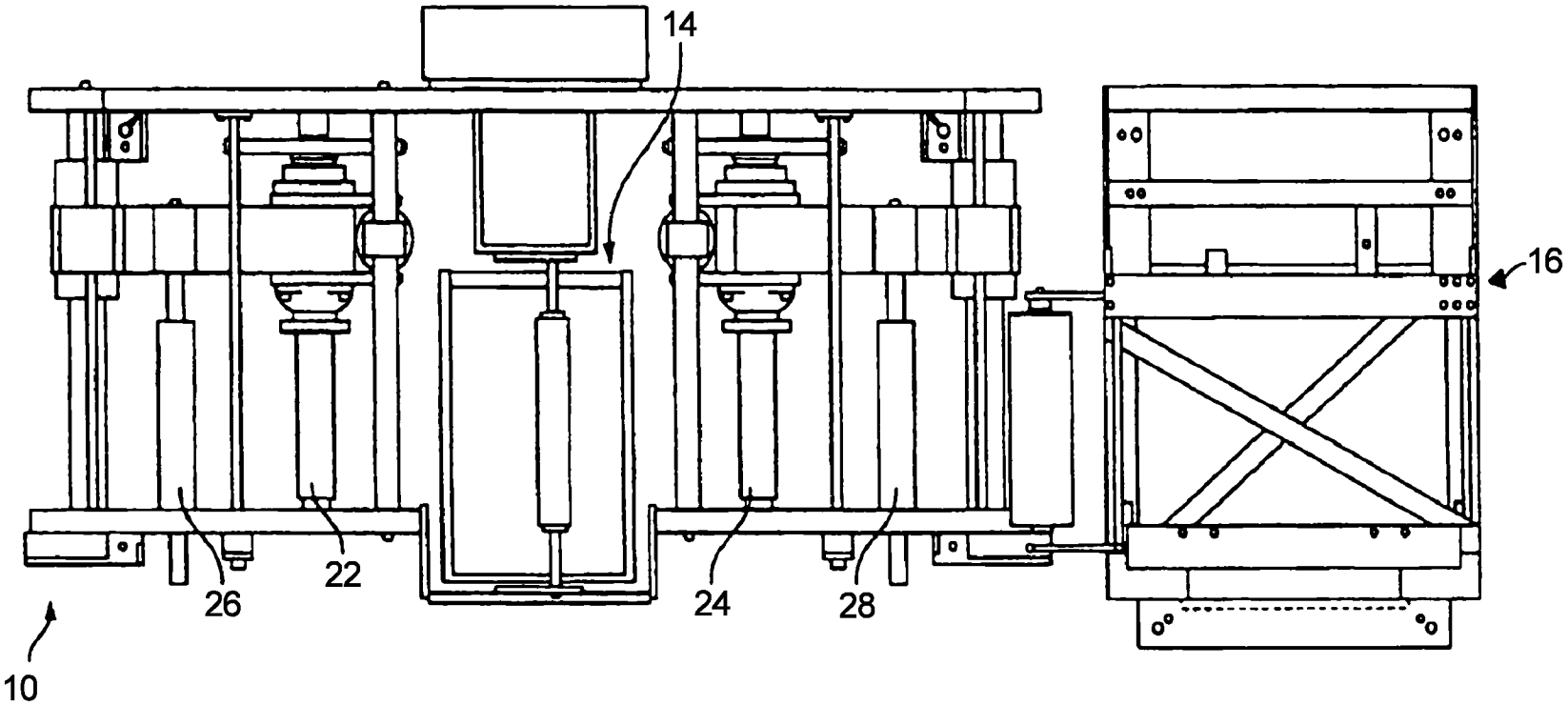
FIG. 2 is a top plan view of the web splicer shown in FIG. 1.

The embodiments described herein relate to an apparatus and methods for forming a butt splice to join a leading edge of a newly prepared web of material from a new roll of material (referred to herein as a "new web") to a trailing edge of a web of material from an expiring roll of material (referred to herein as an "expiring web") that is being fed to a continuous web processing operation. The methods described herein include both a linear process and a monolithic process for forming the butt splice using an ultraviolet (UV)-curable liquid adhesive applied within a gap formed between the leading edge of the new web and the trailing edge of the expiring web.

The embodiments described herein are suitable for joining webs formed of suitable materials including, without limitation, one or more of the following materials: film, coated film or material, fiber, fiberglass, paper including cardboard, nonwoven web, woven web, and other suitable materials and combinations thereof known to those having ordinary skill in the art. Moreover, although this disclosure describes the use of a UV-curable liquid adhesive to form the butt splice, other suitable adhesives known to those having ordinary skill in the art may also be used to form a sufficiently strong butt splice.

In one aspect, a method of forming a butt splice includes a linear process, as described in greater detail below, wherein the leading edge of the new web and the trailing edge of the expiring web are cut or trimmed and temporarily immobilized, a UV-curable liquid adhesive is applied within a gap formed between the leading edge of the new web and the trailing edge of the expiring web, and the liquid adhesive is cured using a suitable UV-curing light source, such as one or more suitable light emitting diodes (LEDs), to form a sufficiently strong butt splice.

In another aspect, a method of forming a butt splice includes a monolithic process, as described in greater detail below, wherein the leading edge of the new web is cut or trimmed and temporarily immobilized, the trailing edge of the expiring web is cut or trimmed using a shear blade extending from a splicer assembly, a UV-curable liquid adhesive is dispensed from an adhesive applicator manifold defined in the splicer assembly and applied within a gap formed between the leading edge of the new web and the trailing edge of the expiring web, and the liquid adhesive is cured using a suitable UV-curable light source, such as one or more suitable LEDs, to form a sufficiently strong butt splice.

Referring now to the drawings, wherein like reference numerals denote like or corresponding parts throughout the drawing figures, and particularly to FIGS. 1-8, the apparatus and methods as described herein are particularly suitable for use with a web splicer 10 configured for a continuous web processing operation, whereby a leading edge of a web from a new roll of material and a trailing edge of a web from an expiring roll of material are both trimmed or cut and subsequently joined together via a butt splice. Web splicer 10 includes an unwind stand 12, a splicing apparatus 14, and a storage festoon 16. Rolls of web material 18, 20 are placed onto spindles 22, 24 of unwind stand 12. Unwind stand 12 also includes at least one idler roller 26, 28 for each spindle 22, 24. The web material that is mounted onto spindle 22, 24 is routed around associated idler roller 26, 28 and towards splicing apparatus 14. The web material is then threaded between entrance rollers 30, 32, as shown in FIG. 4, and into splicing apparatus 14.

Figure 3:
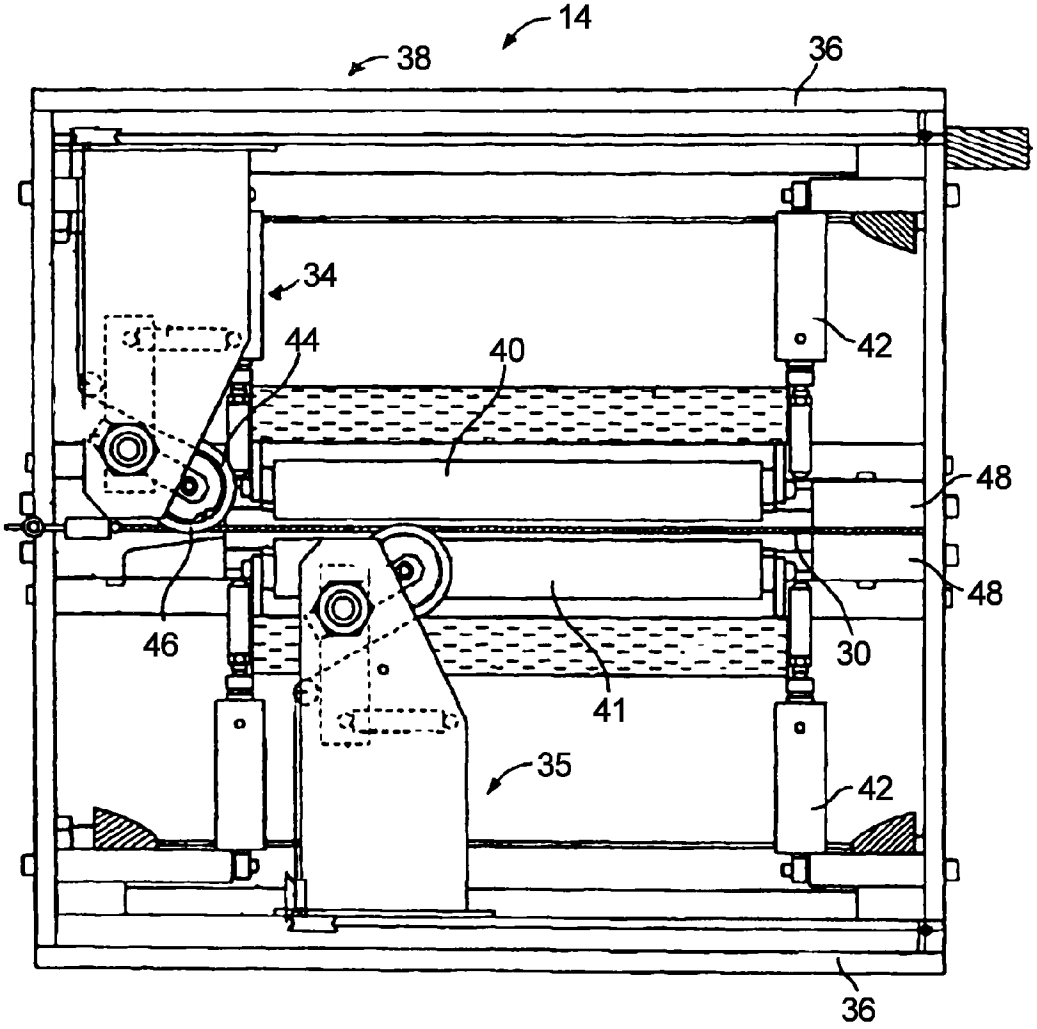
FIG. 3 is a top plan view of an exemplary splicing apparatus for the web splicer.
Figure 4:
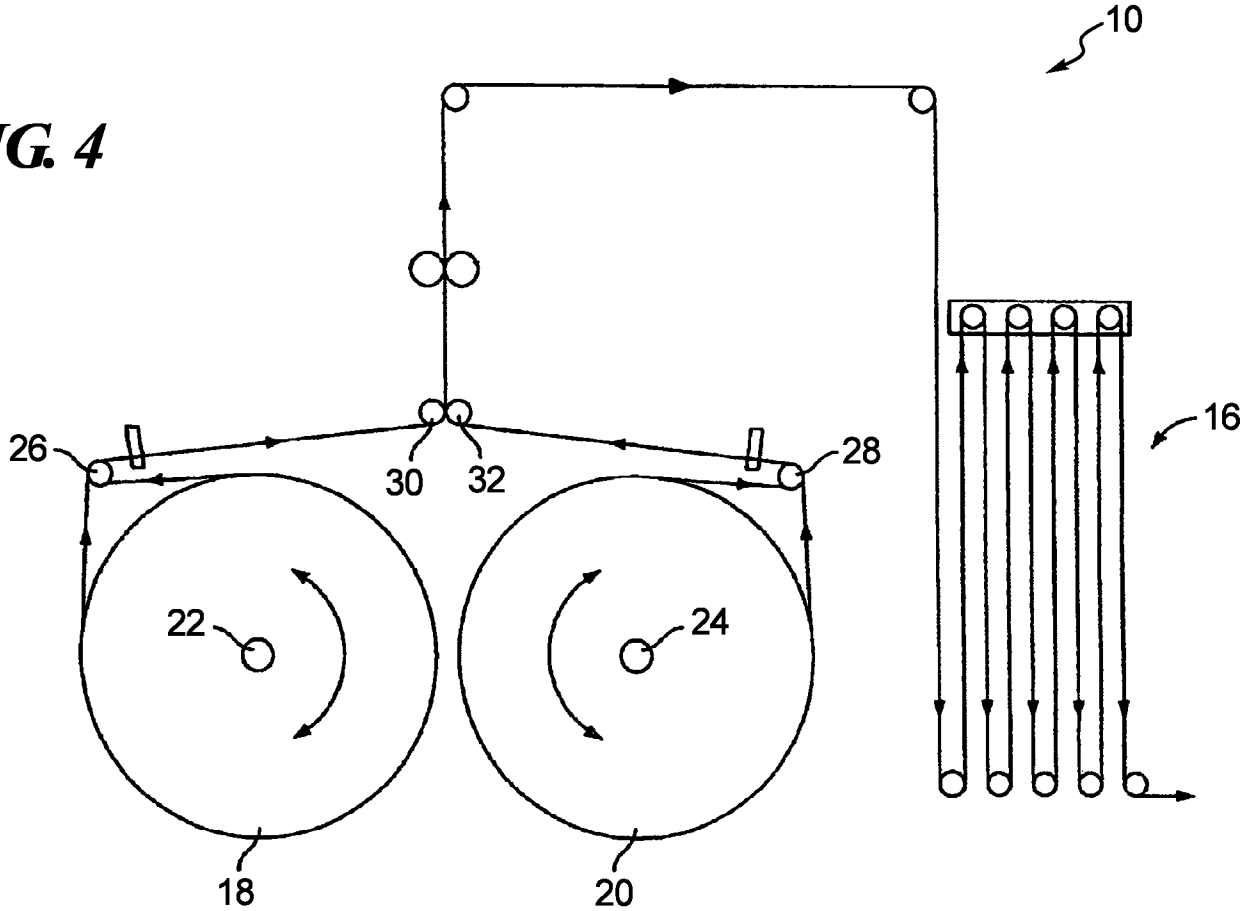
FIG. 4 is a schematic illustration of threaded rolls of web material in an exemplary web splicer.

As shown in FIG. 3, splicing apparatus 14 includes an anvil 30 positioned between splicing assemblies 34, 35 and substantially parallel to end members 36 of a splicer frame 38. On both sides of anvil 30 are pivotable nip rolls 40, 41. When in an open position, nip rolls 40, 41 permit the web of material to pass along the sides of anvil 30. However, when a web of material is to be trimmed or cut, respective nip roll 40, 41 located adjacent to that web of material is pivoted via activation of associated power cylinders 42 to a closed position against anvil 30, whereby nip roll 40, 41 holds the web of material during the splicing operation, described below.

The new web may be manually pulled until the new web threaded through splicing apparatus 14 is taut, at which time nip roll 40 adjacent to the new web is pivotably moved to a closed position to secure a portion of the new web against anvil 30. The activation of nip roll 40 may be achieved by the movement of a shear wheel assembly 44, for example. This movement activates a sensor such as a whisker valve that actuates power cylinders 42 that are operably connected to nip roll 40 that is adjacent to the new web to be trimmed or cut. Nip roll 40 is then pivoted to a closed position, whereby nip roll 40 secures a portion of the new web against anvil 30.

The linear movement of shear wheel assembly 44 towards and across the new web that is secured against the adjacent first side of anvil 30 may occur via an operator manually moving shear wheel assembly 44. Alternatively, shear wheel assembly 44 may be connected to a double acting pneumatic cylinder or other suitable automation mechanism, whereby the activation of the pneumatic cylinder initiates the linear movement of shear wheel assembly 44 across anvil 30 and the secured new web.

As shear wheel assembly 44 moves from an initial first position to a second position across a width of the new web, a shear wheel 46 rotates to trim or cut a leading edge of the new web. After shear wheel 46 has completely run across the leading edge of the trimmed web material, and shear wheel assembly 44 has reached its second position against a stop 48, the excess cut or trimmed web material is removed. The leading edge of the trimmed new web is now substantially even with or congruent to the cutting edge of anvil 30. Once the leading edge has been trimmed, shear wheel assembly 44 may be returned from its second position to its initial first position.

In preparation for trimming the trailing edge of the expiring roll, the operator must make a decision as to when to initiate the splicing of the trailing edge of the expiring web. Once this decision is made, the operator pushes a switch that activates power cylinders 42 that are operably connected to nip roll 41 adjacent to the expiring web. Nip roll 41 is then pivoted to a closed position to secure a portion of the expiring web against anvil 30. Once secured, splicing assembly 35 adjacent to the expiring web is actuated to begin the splicing process to join the leading edge of the new web to the trailing edge of the expiring web.

Figures 5, 6:
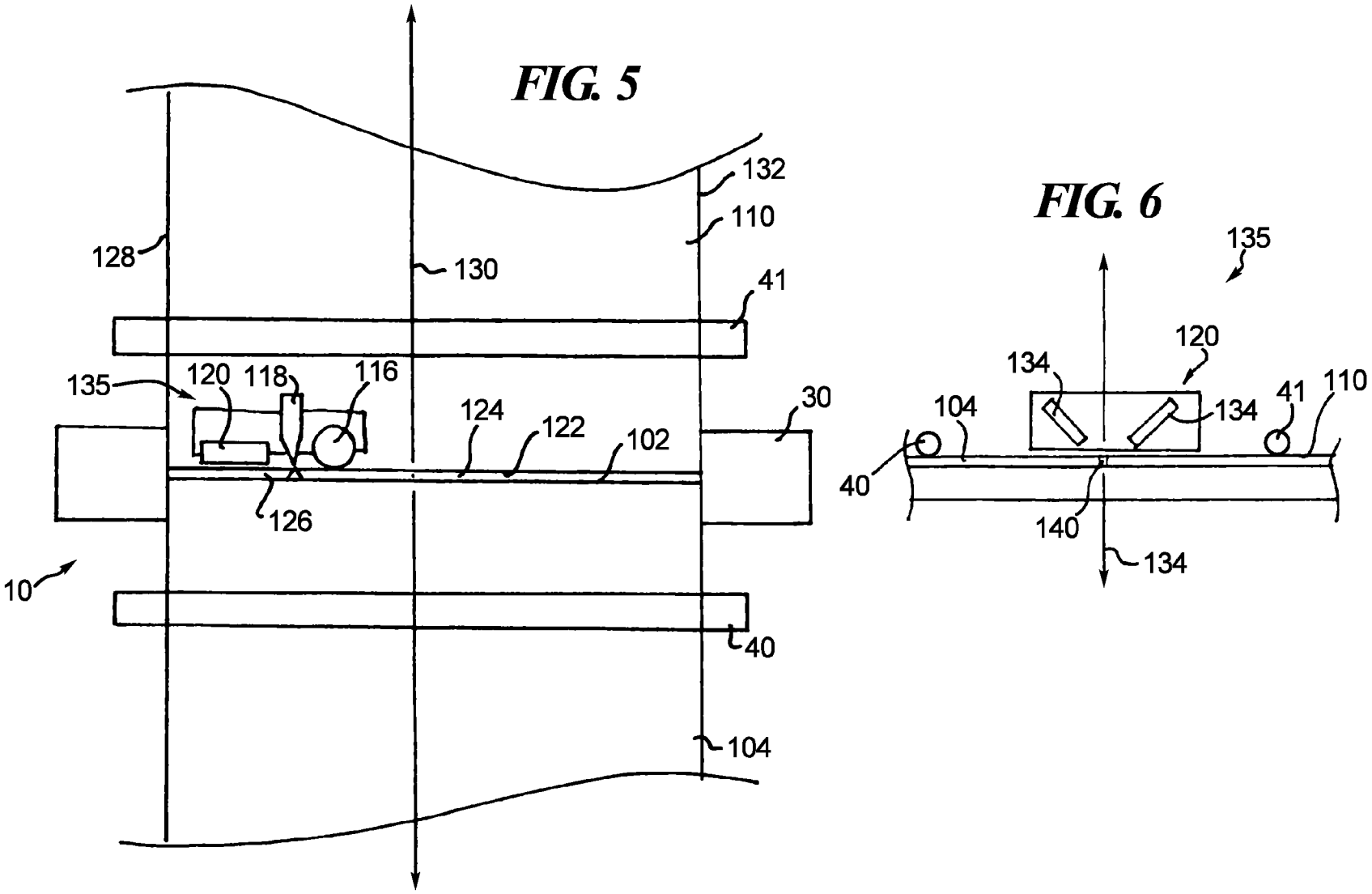
FIG. 5 is a schematic front view of an exemplary splicing assembly for forming a butt splice to join a leading edge of a new web of material to a trailing edge of an expiring web of material.
FIG. 6 is a schematic side view of a portion of the splicing assembly shown in FIG. 5, illustrating exemplary light sources suitable for curing a UV-curable liquid adhesive within a gap defined between the new web of material and the expiring web of material.

Referring further to FIGS. 5 and 6, in one embodiment, splicing assembly 135 forms a butt splice to join together the leading edge of the new web and the trailing edge of the expiring web, as the expiring web runs downstream under tension along a predetermined path of travel. As shown in FIGS. 5 and 6, a leading edge 102 is formed on a new web of material 104 by splicing or cutting the new web 104. Once new web 104 is cut or spliced, new web 104 is temporarily secured against a surface of an anvil 30 by nip 40. With leading edge 102 secured against anvil 30, expiring web 110 is temporarily secured against anvil 30 by nip 41. With both new web 104 and expiring web 110 secured against anvil 30, splicing assembly 135 is moved laterally across a width of expiring web 110. Splicing assembly 135 includes a shear wheel 116, an adhesive applicator 118, and a curing device 120 including one or more UV-curing light sources. As splicing assembly 135 moves across expiring web 110, shear wheel 116 cuts or trims expiring web 110 to form a trailing edge 122 along the cutting edge of anvil 30.

Trailing edge 122 is registered with leading edge 102 to define a gap 124 between leading edge 102 and trailing edge 122 along a width of new web 104 and a width of expiring web 110. In one embodiment, gap 124 is not greater than 1 millimeter (mm); however, in alternative embodiments gap 124 may exceed 1 mm and may be, for example, not greater than 2 mm. With each of leading edge 102 and trailing edge 122 secured against anvil 30 by associated nip 40, 41, adhesive applicator 118 dispenses a controllable amount of UV-curable liquid adhesive 126 within gap 124. In certain embodiments, adhesive applicator 118 includes a needle applicator to facilitate accurately dispensing a desired quantity of liquid adhesive in a desired area within gap 124. As shown in FIG. 5, adhesive applicator 118 is operatively coupled to shear wheel 116 such that adhesive applicator 118 moves across expiring web 110 with shear wheel 116. Adhesive applicator 118 is controlled using a suitable controller (not shown) to dispense a precise quantity of adhesive as adhesive applicator 118 moves along a length of gap 124 between a first lateral edge 128 of expiring web 110, substantially parallel to a longitudinal axis 130 of expiring web 110, and an opposing second lateral edge 132 of expiring web 110, as shown in FIG. 5.

Curing device 120 is operatively coupled to adhesive applicator 118 such that curing device 120 follows adhesive applicator 118 along gap 124 to cure adhesive 126 dispensed in gap 124. In one embodiment, curing device 120 includes one or more ultraviolet (UV) light sources 134 as shown in FIG. 6, such as light emitting diodes (LEDs), configured to emit UV light at a suitable intensity to cure adhesive 126 within a desired time. In a particular embodiment, light sources 134 are offset with respect to a z-axis 134 normal to longitudinal axis 128, as shown in FIG. 6, to allow for better visibility of gap 124 and adhesive 126 and/or to accommodate off-gassing during the curing process, for example. In an alternative embodiment, curing device 120 includes one or more light sources 134 that are fixed or stationary with respect to expiring web 110 and directed onto an area in which adhesive 126 is dispensed or applied such that after adhesive applicator 118 moves across gap 124, light sources 134 are activated to emit UV light at a suitable intensity to cure adhesive 126 within a desired time. For example, a wattage output of each light source 134 within curing device 120 is controllable to emit UV light at an intensity suitable to cure adhesive 126 within a set time. In this embodiment, light sources 134 may also be controlled by a timer or other suitable controller (not shown) such that light sources 134 are activated to emit light only during the curing process.

Once adhesive 126 is cured, a sufficiently strong butt splice 140 is formed, as shown in FIG. 6, to join new web 104 to expiring web 110. Nips 40, 41 are then released to allow the joined webs to move downstream. In one embodiment, once splicing assembly 135 has cut the expiring web, a sensor, such as a whisker valve, deactivates nips 40, 41 so that the newly spliced web may run through the remainder of web splicer 10 and towards storage festoon 16.

Figure 8:
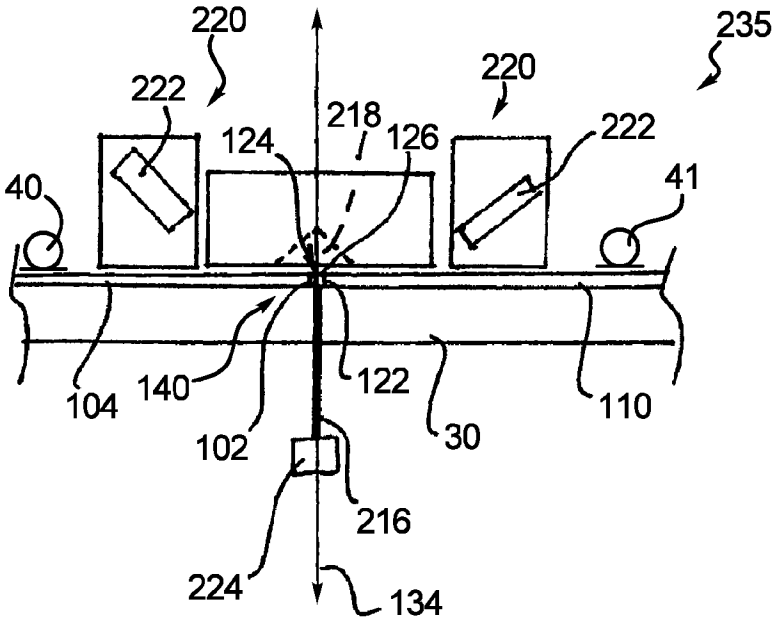
FIG. 8 is a schematic side view of a portion of the splicing assembly shown in FIG. 7, illustrating exemplary light sources suitable for curing a UV-curable liquid adhesive within a gap defined between the new web of material and the expiring web of material.
Figure 7:
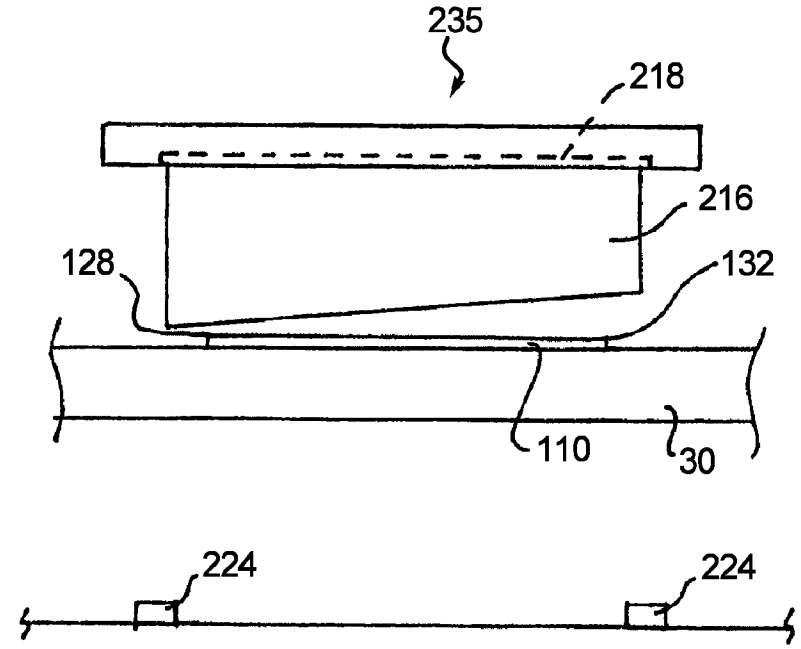
FIG. 7 is a schematic front view of an exemplary splicing assembly for forming a butt splice to join the leading edge of a new web to the trailing edge of an expiring web.

Referring further to FIGS. 7 and 8, in an alternative embodiment, splicing assembly 235 forms a butt splice to join together the leading edge of the new web and the trailing edge of the expiring web, as the expiring web runs downstream under tension along a predetermined path of travel. As shown in FIGS. 7 and 8, leading edge 102 is formed on new web of material 104 by splicing or cutting new web 104. Once new web 104 is cut or spliced, new web 104 is temporarily secured against anvil 30 by nip 40, as shown in FIG. 8, to facilitate joining new web 104 to expiring web 110. With leading edge 102 secured against anvil 30, in one embodiment, expiring web 110 is temporarily secured against anvil 30 by nip 41. With both new web 104 and expiring web 110 secured to anvil 30, splicing assembly 235 is moved, such as in a vertical gravity drop, towards expiring web 110 registered with new web 104. In this embodiment, splicing assembly 235 includes a shear blade 216 and an adhesive applicator manifold 218. In one embodiment, a curing device 220, including one or more UV-curing light sources 222 as shown in FIG. 8, is positioned with respect to a support surface of anvil 30 on which each of new web 104 at leading edge 102 and expiring web 110 at trailing edge 122 is supported. As splicing assembly 235 moves through expiring web 110, shear blade 216 cuts or trims expiring web 110 to form a trailing edge 122. Trailing edge 122 is registered with leading edge 102 to define gap 124 between leading edge 102 and trailing edge 122 along a width of new web 104 and a width of expiring web 110. In one embodiment, gap 124 is not greater than 1 mm; however, in alternative embodiments gap 124 may exceed 1 mm and may be, for example, not greater than 2 mm.

As shearing blade 216 passes through expiring web 110, one or more stops 224, shown in FIG. 7, are positioned under anvil 30 to stop or prevent further movement of shearing blade 216 and facilitate accurately positioning adhesive applicator manifold 218 over gap 124 defined between leading edge 102 and trailing edge 122. With each of leading edge 102 and trailing edge 122 secured by respective nip 40, 41, adhesive applicator manifold 218 dispenses a controllable amount of UV-curable liquid adhesive 126 within gap 124. In certain embodiments, adhesive applicator manifold 218 includes one or more needle applicators to facilitate accurately dispensing a desired quantity of liquid adhesive in a desired area within gap 124. In one embodiment, adhesive applicator manifold 218 is controlled using a suitable controller (not shown) to dispense a precise quantity of adhesive as adhesive applicator manifold 218 is positioned over a length of gap 124 between a first lateral edge 128 of expiring web 110 and second lateral edge 132 of expiring web 110.

As shown in FIG. 8, curing device 220 includes one or more UV-curing light sources 222 positioned on opposing lateral sides of gap 124. In this embodiment, each light source 222 is fixed or stationary with respect to expiring web 110 and directed onto an area in which adhesive 126 is dispensed or applied such that after adhesive applicator manifold 218 dispenses adhesive 126 and is retracted, such as in an upward direction, to an initial position, light sources 222 are activated to emit UV light at a suitable intensity to cure adhesive 126 within a desired time. For example, a wattage output of each light source 222 within curing device 220 is controllable or selectable to emit UV light at an intensity suitable to cure adhesive 126 within a set time. In this embodiment, light sources 222 may also be controlled by a timer or other suitable controller (not shown) such that light sources 222 are activated to emit light only during the curing process. In one embodiment, curing device 220 includes one or more ultraviolet (UV) light sources 222 as shown in FIG. 8, such as LEDs, configured to emit UV light at a suitable intensity to cure adhesive 126 within a desired time. In a particular embodiment, light sources 222 are offset with respect to a z-axis 134 normal to longitudinal axis 128, as shown in FIG. 8, to allow for better visibility of gap 124 and adhesive 126 and/or to accommodate off-gassing during the curing process, for example. In alternative embodiments, curing device 220 is operatively coupled to adhesive applicator manifold 218 such that curing device 220 moves with adhesive applicator manifold 218 towards gap 124 to cure adhesive 126 dispensed in gap 124.

Once adhesive 126 is cured, a sufficiently strong butt splice 140 is formed to join new web 104 to expiring web 110. Nips 40, 41 are then released to allow the joined webs to move downstream. In one embodiment, once splicing assembly 235 has cut expiring web 110 and reaches its initial position, a sensor, such as a whisker valve, deactivates nips 40, 41 so that the newly spliced web may run through the remainder of web splicer 10 and towards storage festoon 16.

The rate at which butt splice 140 is formed according to the embodiments described herein is controlled, at least in part, by one or more of the following steps: splicing or cutting new web 104 to form leading edge 102; splicing or cutting expiring web 110 to form trailing edge 122; applying or dispensing adhesive 126; allowing suitable time for adhesive 126 to spread within gap 124 and/or diffuse or wick into webs 104 and 110, as desired; and curing adhesive 126 to form butt splice 140. The ability to control the rate at which butt splice 140 is formed is highly advantageous when expiring web 110 continues to move through the downstream web processing machine as new web 104 is joined or spliced to expiring web 110.

Referring to FIGS. 9-19, the apparatus and methods as described herein are particularly suitable for use with a web splicer 310 configured for a continuous web processing operation, whereby a leading edge of a newly prepared web of material from a new roll of material or a "new web" to a trailing edge of a web of material from an expiring roll of material or an "expiring web" are both trimmed or cut and subsequently joined together via a butt splice.

Figure 9:
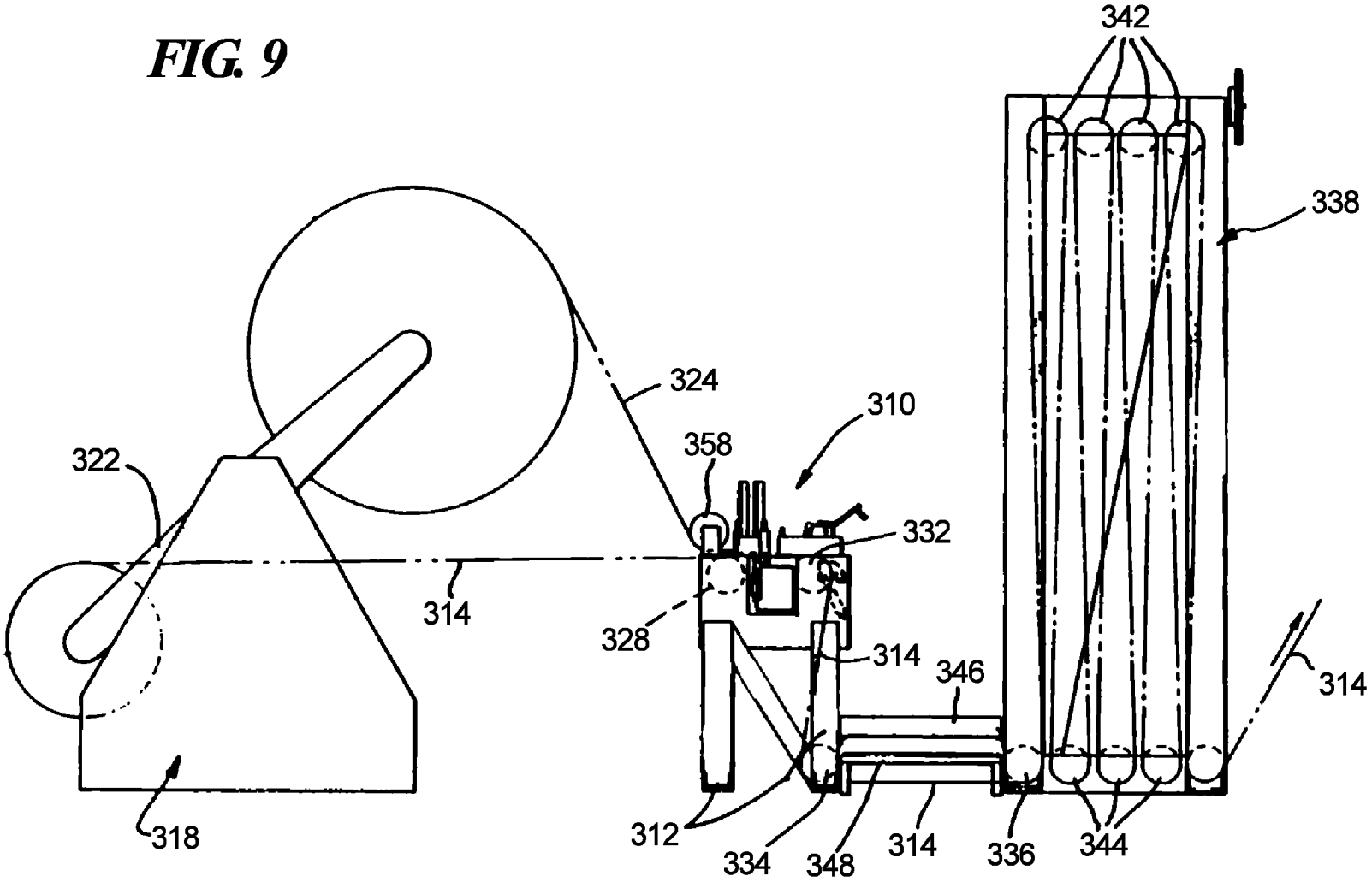
FIG. 9 is a schematic view of a roll unwind stand, an exemplary web splicer, and a festoon.

An expiring web 314 is supported on a conventional turret type, roll unwind stand, shown generally at 318. As shown in FIG. 9, expiring web 314 moves along a substantially horizontal path of travel to web splicer 310 while supported on one end of a conventional unwind arm assembly 322. Unwind arm assembly 322 is connected, midway between its ends, to unwind stand 318 and is adapted to be selectively pivoted about its point of connection with unwind stand 318. A new web 324 is supported on the other, opposite end of unwind arm assembly 322. Conventional roll braking means, not shown, are included on the ends of unwind arm assembly 322 and may, upon receipt of a signal, be utilized to stop the rotation of the rolls and thus stop the webs from running off the rolls.

New web 324 is led to web splicer 310 in preparation for a splice. When this is done, the path of travel of new web 324 to web splicer 310 is at an angle to the horizontal. After a splice has been made, such that expiring web 314 is no longer being fed to web splicer 310, another new roll of material will then be supported on the one end of unwind arm assembly 322 in place of expiring web 314. Thereafter, new web 324 will be moved to the position now occupied by expiring web 314 and the other new roll will be supported where new web 324 is shown in FIG. 9.

As noted above, expiring web 314 moves along a substantially horizontal path of travel to and through web splicer 310. More specifically, expiring web 314 enters web splicer 310 by passing around an entrance idler roll 328 mounted on web splicer 310. Thereafter, expiring web 314 passes around an exit idler roll 332 mounted on web splicer 310 adjacent to its exit end. Expiring web 314 is directed downwardly from idler roll 332 to a second exit roll 334 mounted between two legs 312 of web splicer 310. Expiring web 314 is then directed along a generally horizontal path to entrance roll 336 in a festoon 338. Upon exiting from festoon 338, expiring web 314 travels to a web utilization apparatus which may be, for example, a printing press, not shown.

Festoon 338 is of conventional design and construction. It acts as an accumulator for running expiring web 314 such that the web utilization apparatus does not have to be stopped when the portion of expiring web 314 in web splicer 310 is stopped during a splicing operation. Festoon 338 includes upper and lower sets of rolls 342 and 344, respectively, about which expiring web 314 passes. When the portion of expiring web 314 in web splicer 310 is stopped, upper set of rolls 342 moves downwardly toward lower set of rolls 344.

A horizontal platform 346 is mounted between web splicer 310 and festoon 338. Platform 346 may be used by the operator while preparing new web 324 for a splice. A step 348, adjacent to platform 346, assists the operator in climbing up and down from platform 346.

Figure 10:
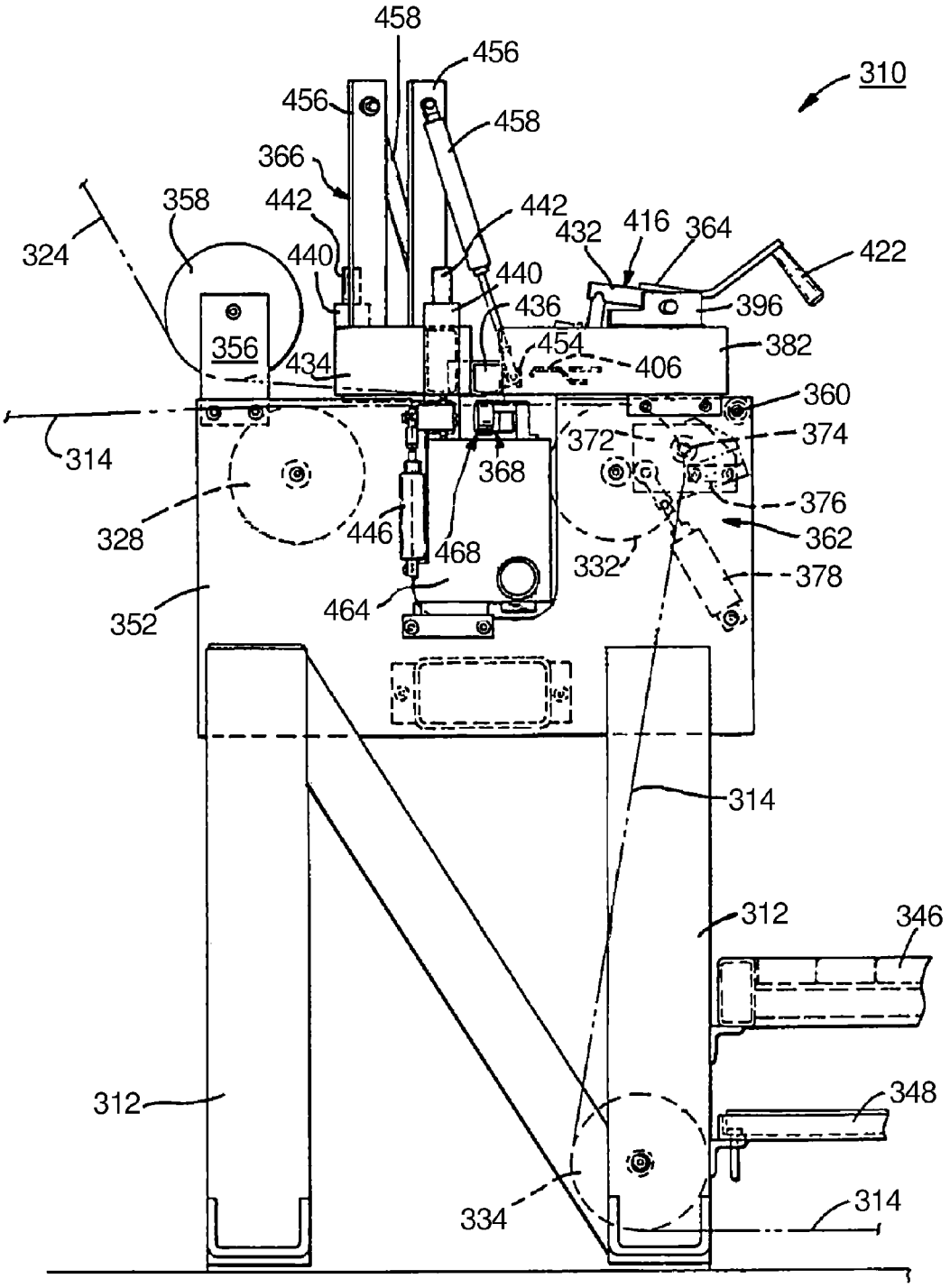
FIG. 10 is an enlarged side elevation view of the web splicer shown in FIG. 9.
Figure 11:
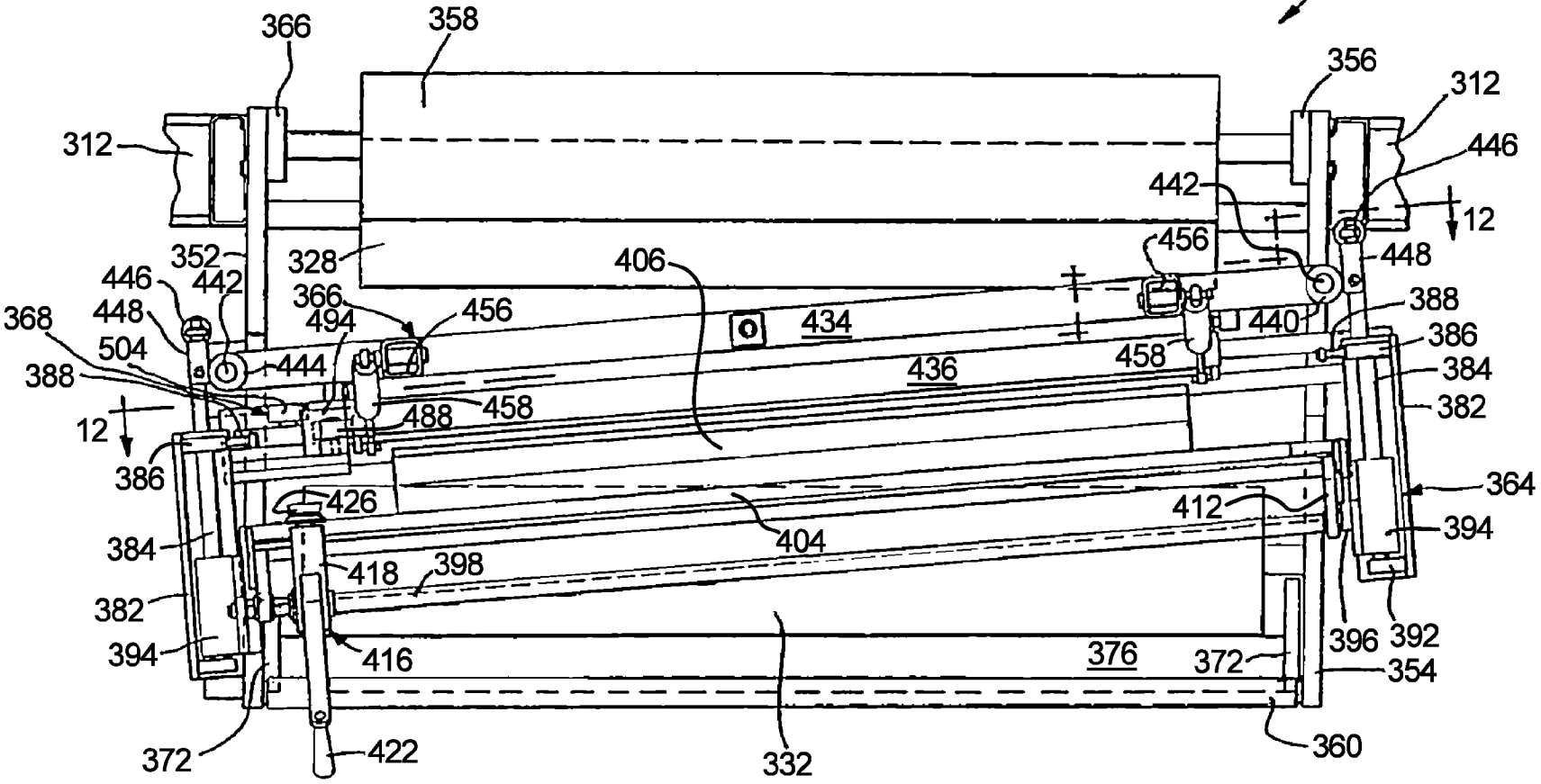
FIG. 11 is a top plan view of the splicer shown in FIG. 10.
Figure 15:
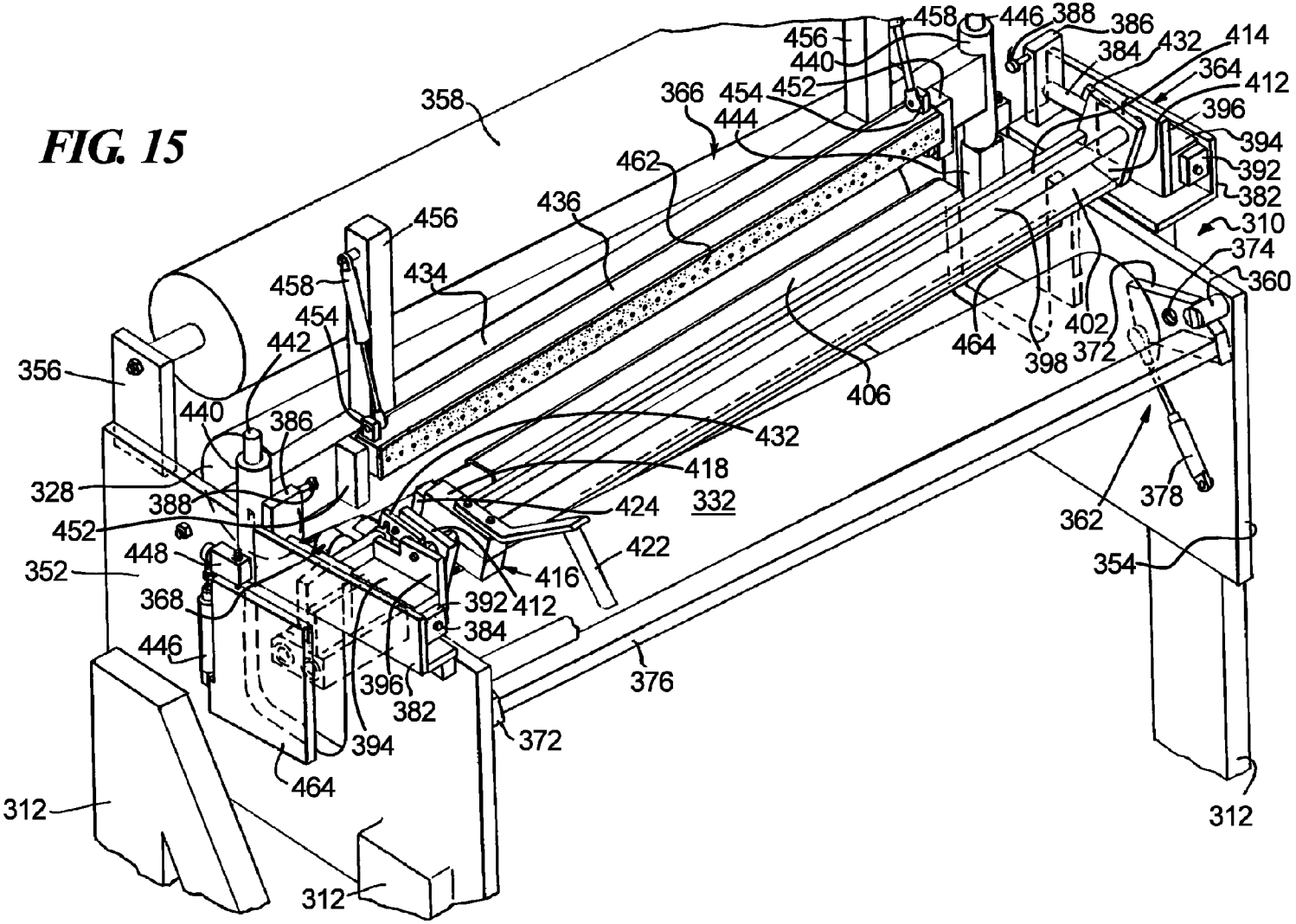
FIG. 15 is a perspective view of the exit end of the web splicer shown in FIG. 9.

Referring now to FIGS. 10, 11 and 15, web splicer 310 includes two parallel, spaced apart side plates 352 and 354. The upper ends of legs 312 are secured to side plates 352 and 354. The ends of idler rolls 328 and 332 are journaled in side plates 352 and 354. A pair of brackets 356 are fastened, at lower ends, to upper, upstream corners of plates 352 and 354 adjacent to the entrance end of web splicer 310. The other, upper ends of brackets 356 project upwardly a short distance. The ends of an idler roll 358 are journaled in the upper ends of brackets 356. New web 324 passes around idler roll 358 as it travels into web splicer 310, as shown in FIG. 9.

As illustrated in FIG. 10, web splicer 310 includes a nip assembly 362, a new web preparation assembly 364, a new web holding assembly 366, and a web cutting and adhering assembly 368, as described in detail herein. Nip assembly 362 serves to clamp expiring web 314 to and about idler roll 332 during a splicing operation. New web preparation assembly 364 is used to prepare the leading end of new web 324 for the splicing operation. New web holding assembly 366 is used to hold a portion of new web 324, immediately upstream of its leading end, in preparation for the splicing operation and during the splicing operation itself. Web cutting and adhering assembly 368 cuts or shears expiring web 314 during the splicing operation and causes the cut part of the trailing end of expiring web 314 and the leading end of new web 324 to be joined as expired web 314 is cut.

Assemblies 364, 366, and 368 are mounted on side plates 352 and 354, as will be described, and extend across web splicer 310 from side plate 352 to side plate 354. In one embodiment, their longitudinal axes (that is, their axes transverse to the path of travel of expiring web 314) are not, however, perpendicular to the path of travel of expiring web 314 through web splicer 310. Rather, these longitudinal axes are offset a small amount, for example, five degrees, from the perpendicular so that the splice, when formed, will be offset from the side edges of the joined webs.

Nip assembly 362 is best shown in FIGS. 10 and 15 and includes a pair of end plates 372. End plates 372 are mounted opposite each other on the inside facing surfaces of side plates 352 and 354. They are connected at 374 to the side plates and are adapted to be pivoted, in a plane parallel to the side plates, about their aligned points of connections 374. A nip bar 376 is connected with one end of each of plates 372. A pair of conventional pneumatic cylinders 378 is connected, at their cylinder ends, to the inside surface of side plates 352 and 354. The rod ends of these cylinders 378 are connected with the other ends of the plates 372. Actuation of cylinders 378 causes end plates 372 to pivot about their points of connection 374 and to bring the inner end of nip bar 376 into and out of engagement with the periphery of idler roll 332. When cylinders 378 urge nip bar 376 into engagement with idler roll 332, expiring web 314 will be clamped between the inner end of bar 376 and idler roll 332.

Referring to FIGS. 10, 11, 15, and 17, new web preparation assembly 364 is supported, at each end, by generally "L" shaped brackets 382. These brackets are, in turn, mounted on the upper ends of side plates 352 and 354 adjacent to the exit end of web splicer 310. Each bracket 382 includes a horizontally disposed guide rod 384. Rods 384 are supported at their upstream or forward ends by upstanding members 386 mounted on the brackets. Coaxially aligned, inwardly directed, facing locating pins 388 are secured to the sides of the upper ends of members 386. The downstream or rearward ends of rods 384 are supported by members 392 that are, in turn, secured to brackets 382.

A carrier block 394 is mounted on each rod 384. These carrier blocks 394 are adapted to be slid along the lengths of rods 384 between members 386 and 392. Each block 394 includes a upwardly directed, inwardly facing mounting plate 396. A guide rod 398 extends across web splicer 310. Its ends are secured adjacent to the upper, downstream corner of these mounting plates 396. An anvil member 402 extends between mounting plates 396 and is secured, at each end, to the lower, upstream corners of these plates 396. Rod 398 and member 402 move with plates 396 when carrier blocks 394 are slid along rods 384.

A cutting element 404 is mounted along the upstream or forward edge of anvil member 402. The upper, upstream corner edge of element 404 is sharpened and serves as a cutting edge along which new web 324 may be cut or trimmed. The length of the cutting element is slightly longer than the width of expiring web 314 and new web 324. The downstream end of a shield 406 is supported below and carried by the central portion of anvil member 402. The upstream end of shield 406 is bent upwardly so that its distal end is substantially in the same plane as cutting element 404 although it is spaced upstream from that element. The width of shield 406 is less than the width of expiring web 314 and new web 324.

Coil extension springs 408 are connected between the downstream ends of brackets 382, beneath member 392, and anvil member 402. These springs 408 are stretched, as shown in FIG. 17, when assembly 364 is moved to its upstream or first position. They thus urge assembly 364 to return to its downstream or second position shown in FIG. 16. A pair of pivotable plates 412 are mounted, adjacent to their upper, downstream corners, on rod 398. The plates are disposed close to plates 396. A nip bar 414 extends between plates 412 and its ends are secured to the plates adjacent to their upstream, lower corners. Plates 412 are sized such that the lower edge surface of nip bar 414 may engage the upper surface of anvil member 402 as described herein.

A trimmer subassembly 416 is also mounted on rod 398 between the plates 412. Subassembly 416 includes a carrier block 418 that may be slid along rod 398 in a direction parallel to the longitudinal axis of the rod. Carrier block 418 may also be pivoted about the longitudinal axis of rod 398. A handle 422 is secured to the upper surface of carrier block 418 to facilitate the sliding and pivotal movement of subassembly 416.

A member 424 is secured to the upstream facing surface of carrier block 418. A knife wheel 426 is mounted on the upstream facing side of member 424 adjacent to the lower end of member 424. Wheel 426 is adapted to rotate about its central axis that is substantially perpendicular to the upstream facing surface of member 424 and thus of carrier block 418. A downstream peripheral edge of wheel 426 is beveled and sharpened so as to form a sharp cutting edge. Wheel 426 is positioned so that its sharpened downstream edge can cooperate with the upstream cutting edge of element 404 as described herein.

A downstream facing roller bearing 428 is mounted on the downstream facing side of member 424. Its axis of rotation is parallel with the axis of rotation of wheel 426. Bearing 428 is positioned so that it may ride along the upper surface of nip bar 414. Bearing 428 facilitates the sliding of carrier block 418 along rod 398. A pair of pin latching members 432 are secured to the upstream, inside upper corners of pivotal plates 412. The upstream ends of pin latching members 432 project upstream beyond the upstream ends of plates 412. Notches are formed in these upstream ends of pin latching members 432 and are sized so that adjacent locating pins 388 may be received within the notches.

Figure 16:
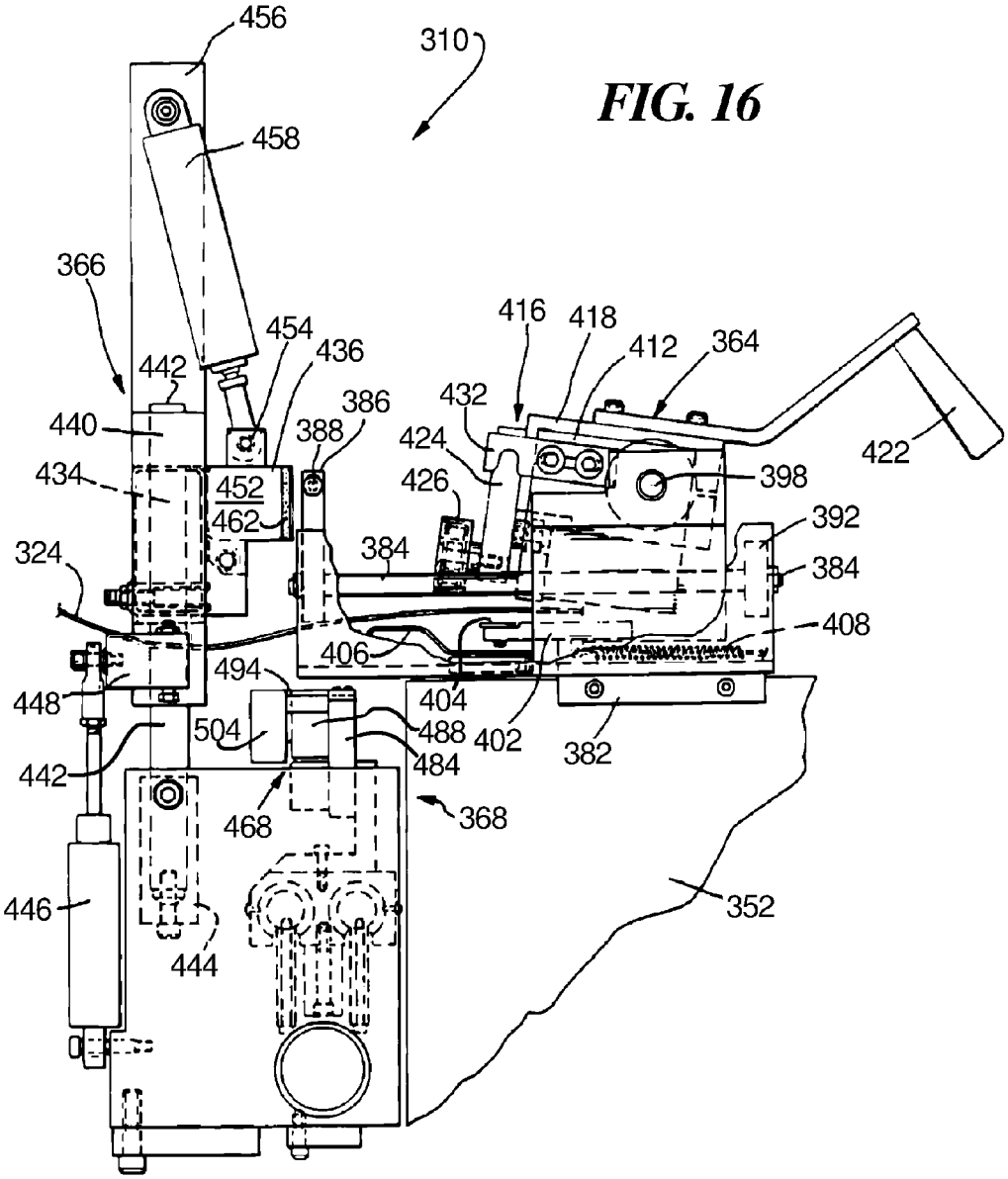
FIG. 16 is an enlarged, partial side elevational view of the upper part of the web splicer shown in FIG. 9 showing, with parts broken away, the leading portion of the new web being fed into the web splicer.
Figure 17:
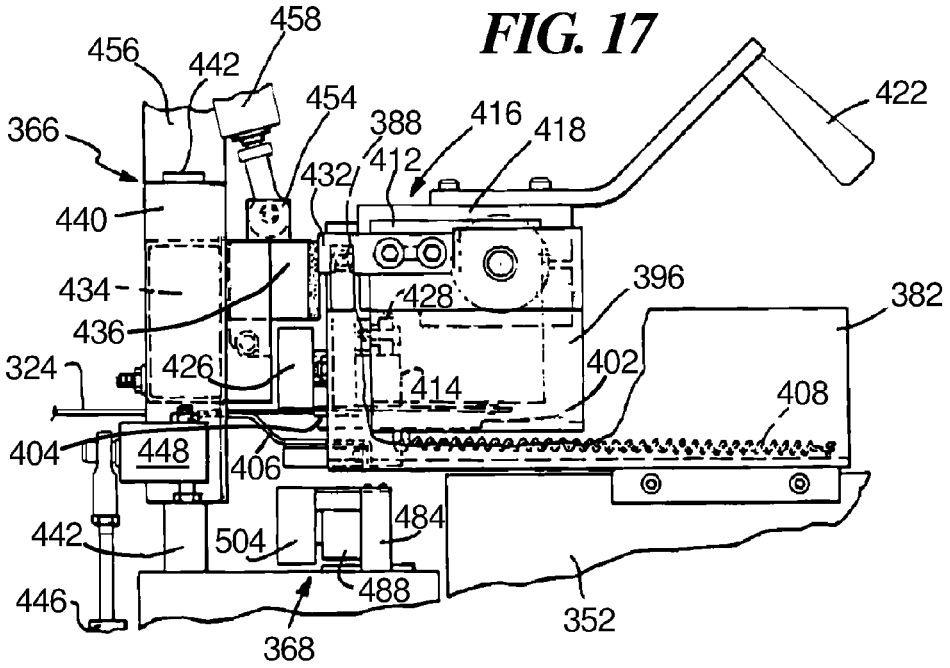
FIG. 17 is an enlarged partial side elevational view of the upper part of the web splicer shown in FIG. 9 and showing the web preparation assembly in its first position to trim the leading end of the new web.

As noted, assembly 364 is adapted to be moved between a first or upstream position, such as shown in FIG. 17, and a second or downstream position, such as shown in FIG. 16. When preparing the leading portion of new web 324 from for a splice, new web 324 is led around idler roller 358 and to and over anvil plate 402. The operator then grasps handle 422 and slides assembly 364, along rods 384, to its first position. Still using handle 422, subassembly 416 is then rotated counterclockwise about the longitudinal axis of rod 398 to its "down" or cutting position as shown in FIG. 17. In this cutting position, the notches in members 432 fit over locating pins 388. Locating pins 388 are set so that when this occurs, the sharpened beveled edge of wheel 426 is adjacent to and in cooperative engagement with the upstream cutting edge of cutting element 404. Similarly, when subassembly 416 is pivoted to its cutting position, the lower surface of nip bar 414 clamps the adjacent, underlying portion of new web 324 against the upper surface of anvil member 402. The operator thereafter slides handle 422, and thus with entire trimmer subassembly 416, along rod 398 while continuing to hold subassembly 416 in its cutting position. This sliding movement of subassembly 416 results in new web 324 being cut by the rotation of knife wheel 426 along the upstream edge of cutting element 404. Hence, the resulting leading end of new web 324 is aligned with and congruent to the upstream edge of cutting element 404. Because of the cooperation between locating pins 388 and the notches in members 432, the cutting edge of element 404 is always precisely located (that is, in the same vertical plane) vis-a-vis assemblies 366 and 368, when assembly 364 is in its first position. This assures that the leading end of each new web, like new web 324, will be located in the same vertical plane after being cut or trimmed by web preparation assembly 364.

Assembly 364 may be moved to its second or downstream position by the operator pivoting handle 412, and thus trimmer subassembly 416 in a clockwise direction to its "up" or non-cutting position. This raises the notches in members 432 off pins 388. The operator, assisted by springs 408, will thereafter return assembly 364 to its second position. Springs 408 serve to retain assembly 364 in that position. Again referring to FIGS. 10, 11, and 15-19, new web holding assembly 366 includes first and second vacuum bars or tubes 434 and 436 having generally rectangular cross-sections. The longitudinal axes of tubes 434 and 436 are parallel. Bar 434 extends across web splicer 310. Annular collar members 440 are formed on the ends of tube 434 and are adapted to slidingly receive the upper ends of vertical guide posts 442. The lower ends of guide posts 442 are secured to members 444 that, in turn, are secured to side plates 352 and 354.

Conventional pneumatic cylinders 446 are secured to the outside surface of plates 464 adjacent to posts 442. More specifically, the cylinder ends of cylinders 446 are secured to the plates while their rod ends are connected, through blocks 448, with annular collar members 440. Actuation of cylinders 446 results in the movement of vacuum bar 434 up and down along posts 442. Vacuum bar 436 is shorter in length than vacuum bar 434. Its ends are journaled for pivotal movement in blocks 452 that are secured to the downstream facing side of vacuum bar 434. A pair of flanges are integrally formed on the upwardly facing side, as shown in FIG. 15, of vacuum bar 436 adjacent to blocks 452. A pair of support towers 456 are secured, at their lower ends, to the upper surface of vacuum bar 434 intermediate its ends. These towers project upwardly above vacuum bars 434 and 436.

Figure 18:
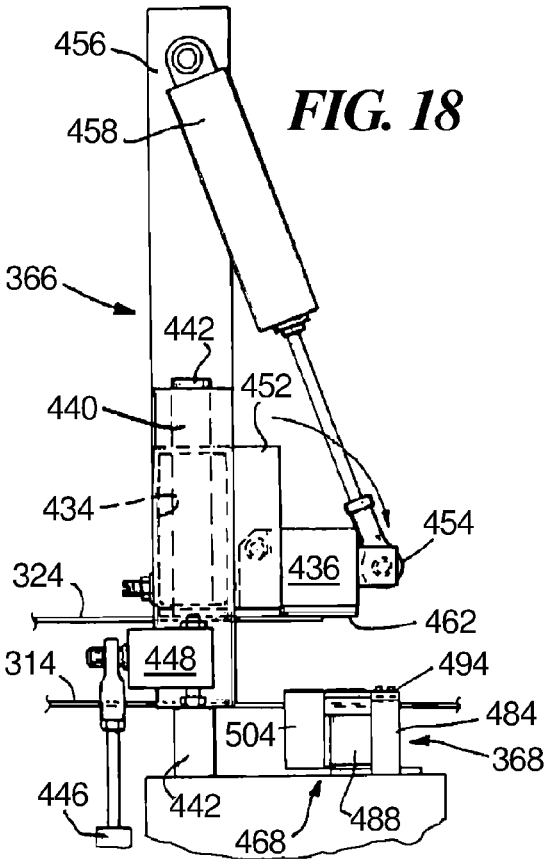
FIG. 18 is an enlarged, partial side elevational view of the new web holding assembly of the web splicer shown in FIG. 9.
Figure 19:
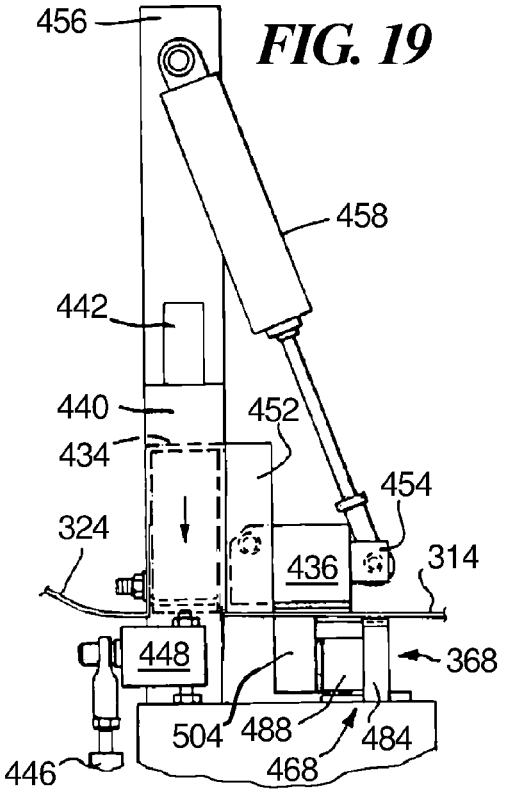
FIG. 19 is a partial side elevational view, similar to that of FIG. 18, but showing the web holding assembly in its second or lower position.
Figure 20A:
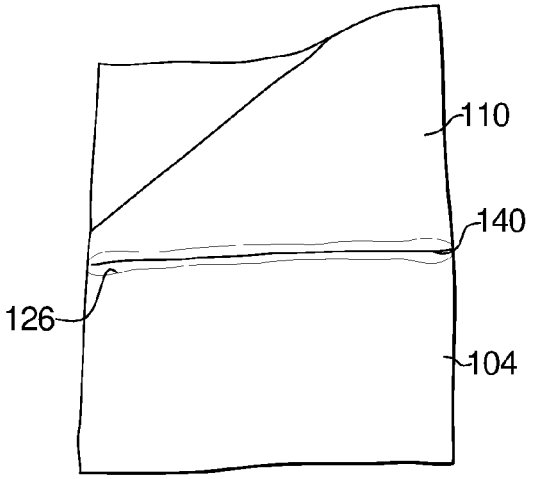
FIG. 20A is a front view of a first web of coated film material joined or spliced to a second web of coated film material by a butt splice according to one embodiment disclosed herein.
Figure 20B:
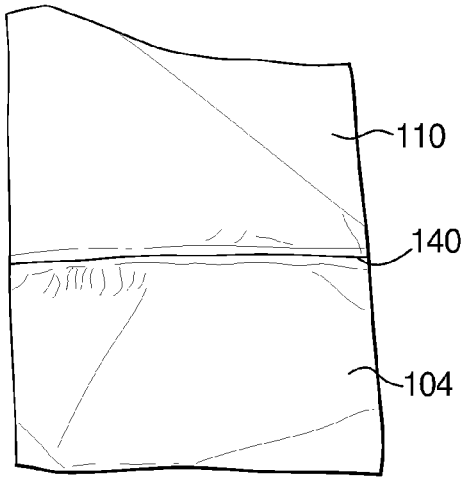
FIG. 20B is an opposing rear view of the spliced webs shown in FIG. 20A.
Figure 21A:
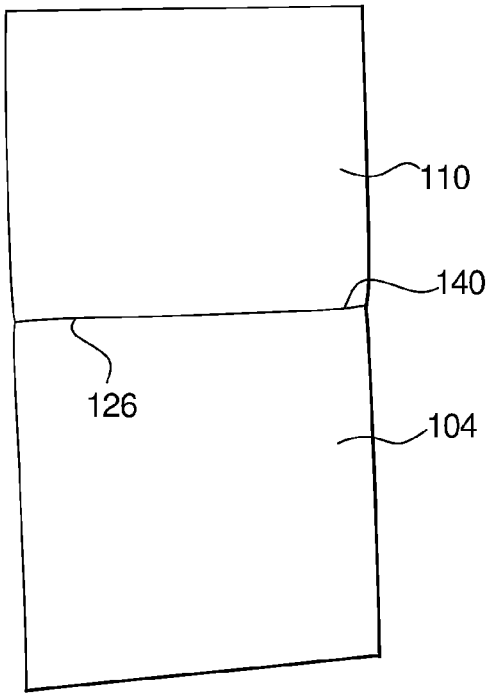
FIG. 21A is a front view of a first web of coated cardboard material joined or spliced to a second web of coated cardboard material by a butt splice according to one embodiment disclosed herein.
Figure 21B:
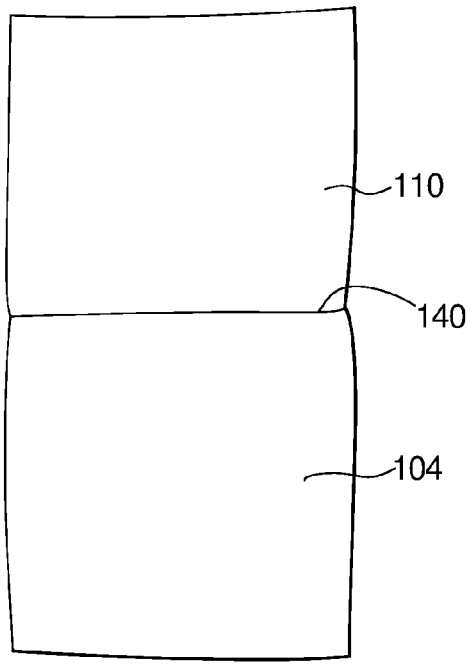
FIG. 21B is an opposing rear view of the spliced webs shown in FIG. 21A.
Figure 22A:
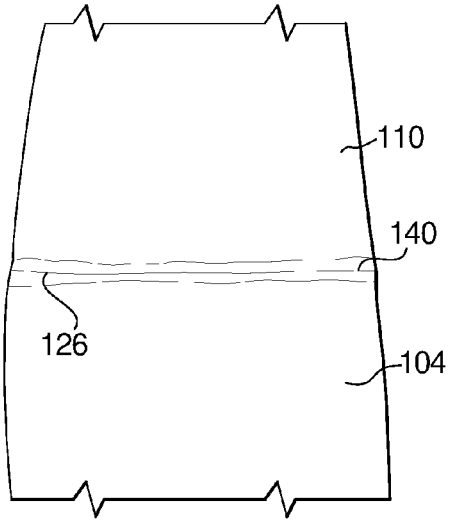
FIG. 22A is a front view of a first web of fiberglass material joined or spliced to a second web of fiberglass material by a butt splice according to one embodiment disclosed herein.
Figure 22B:
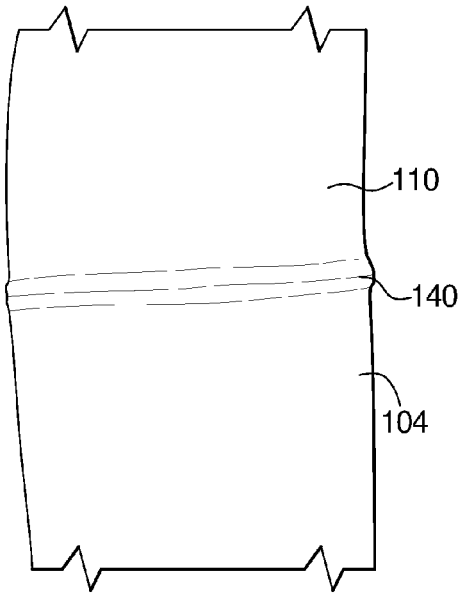
FIG. 22B is an opposing rear view of the spliced webs shown in FIG. 22A.
Figure 23A:
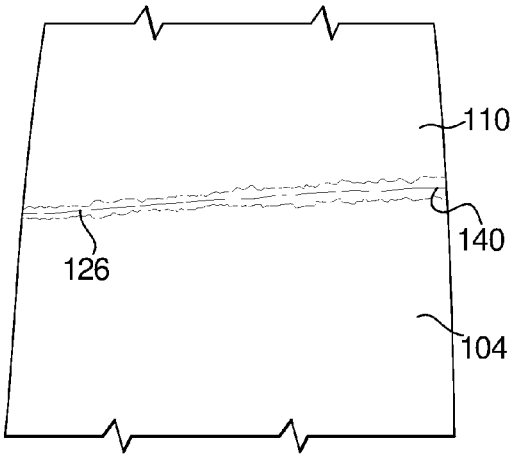
FIG. 23A is a front view of a first web of porous cardboard material joined or spliced to a second web of porous cardboard material by a butt splice according to one embodiment disclosed herein.
Figure 23B:
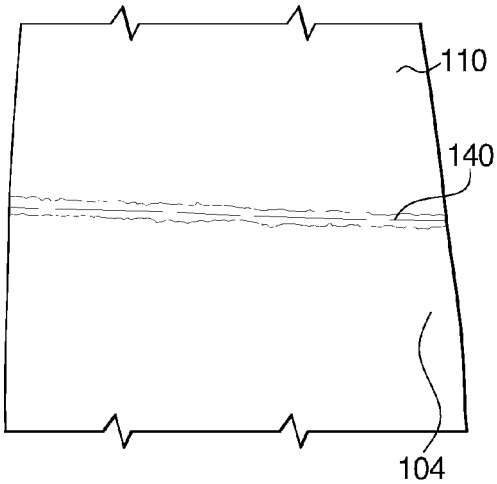
FIG. 23B is an opposing rear view of the spliced webs shown in FIG. 23A.

Conventional pneumatic cylinders 458 are connected, at their cylinder ends, with the upper ends of these support towers. The rod ends of cylinders 458 are connected, by pins, with flanges 454. Actuation of cylinders 458 causes vacuum bar 436 to pivot, through an arc of 90°, from a first position, as shown in FIG. 15, to a second position, as shown in FIGS. 18 and 19. The interiors of vacuum bars 434 and 436 are connected with a conventional vacuum pump, not shown, by conventional tubing, also not shown. Operation of the vacuum pump causes a "vacuum" to be drawn within the interior of these vacuum bars.

The downwardly facing or lower surface of vacuum bar 434 includes a plurality of small holes in the area adapted to overlie the webs running through web splicer 310. A layer of resilient material, such as rubber, is secured to the lower surface of vacuum bar 434. This resilient layer includes similar small holes which coincide with the holes in the lower surface of vacuum bar 434 so that these holes permit air communication between an interior and an exterior of vacuum bar 434. When a portion of new web 324 is brought into surface to surface contact with the lower surface of vacuum bar 434, the vacuum within vacuum bar 434 is sufficient to hold the portion of new web 324 tightly against the lower surface. Similarly, vacuum bar 436 includes a surface 462 that faces downstream when the bar is in its first position and faces downwardly when the bar is in its second position. Vacuum bar 434 is constructed so that when it is in its second position, the vertical plane, that includes the cutting edge of element 404 when web preparation assembly 364 is in its first position, bisects surface 462 so as to divide surface 462 into a downstream half and an upstream half.

Surface 462 has a plurality of small holes therein that permit air communication between the interior and exterior of the vacuum bar. The holes are in the area adapted to overlie expiring web 314 and new web 324 when vacuum bar 436 is in its second position. A layer of resilient material, such as rubber, is also secured to surface 462. Holes in the resilient layer are aligned with the holes in surface 462 so that the vacuum within vacuum bar 436 may communicate with the exterior of vacuum bar 436.

When expiring web 314 is running and before a splice is initiated, assembly 366 is normally in its upper position with vacuum bar 436 rotated to its first position, as shown in FIG. 15. When in this position, the lower surface of vacuum bar 434 is approximately 1¾ inches above expiring web 314 as it runs through web splicer 310. When assembly 366 is moved to its lower position during the course of a splice (and vacuum bar 436 is rotated to its second position as shown in FIG. 19), the lower surface of tube 436 and surface 462 lie in a common, horizontal plane which may be approximately 3⁄16 of an inch above expiring web 314.

Figure 13:
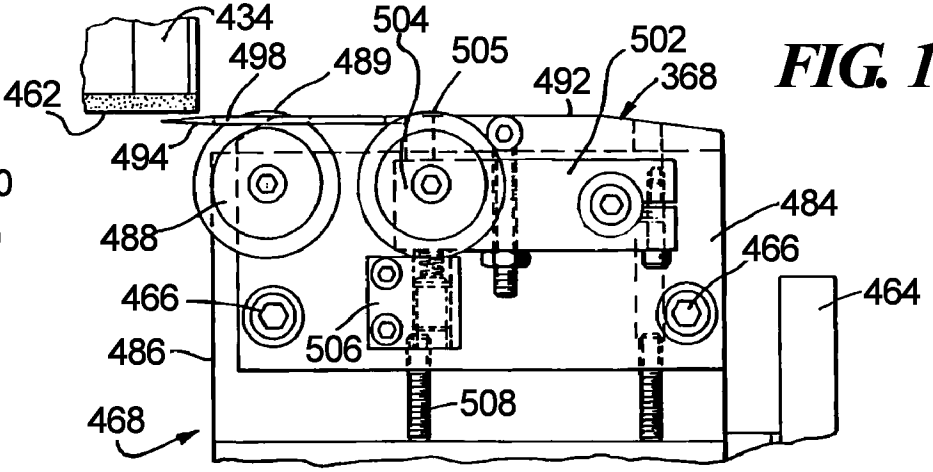
FIG. 13 is an enlarged view of the part of the web splicer designated by the line 13 in FIG. 12.
Figure 14:
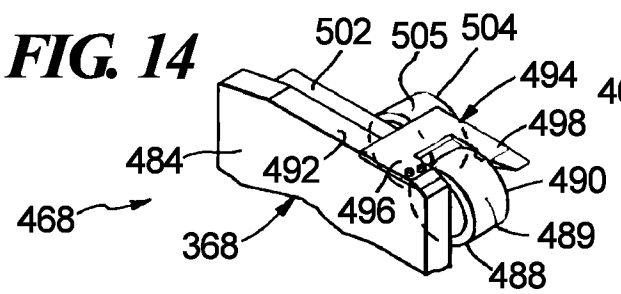
FIG. 14 is an enlarged, partial perspective view of the web cutting and adhering assembly of the web splicer shown in FIG. 9.
Figure 12:
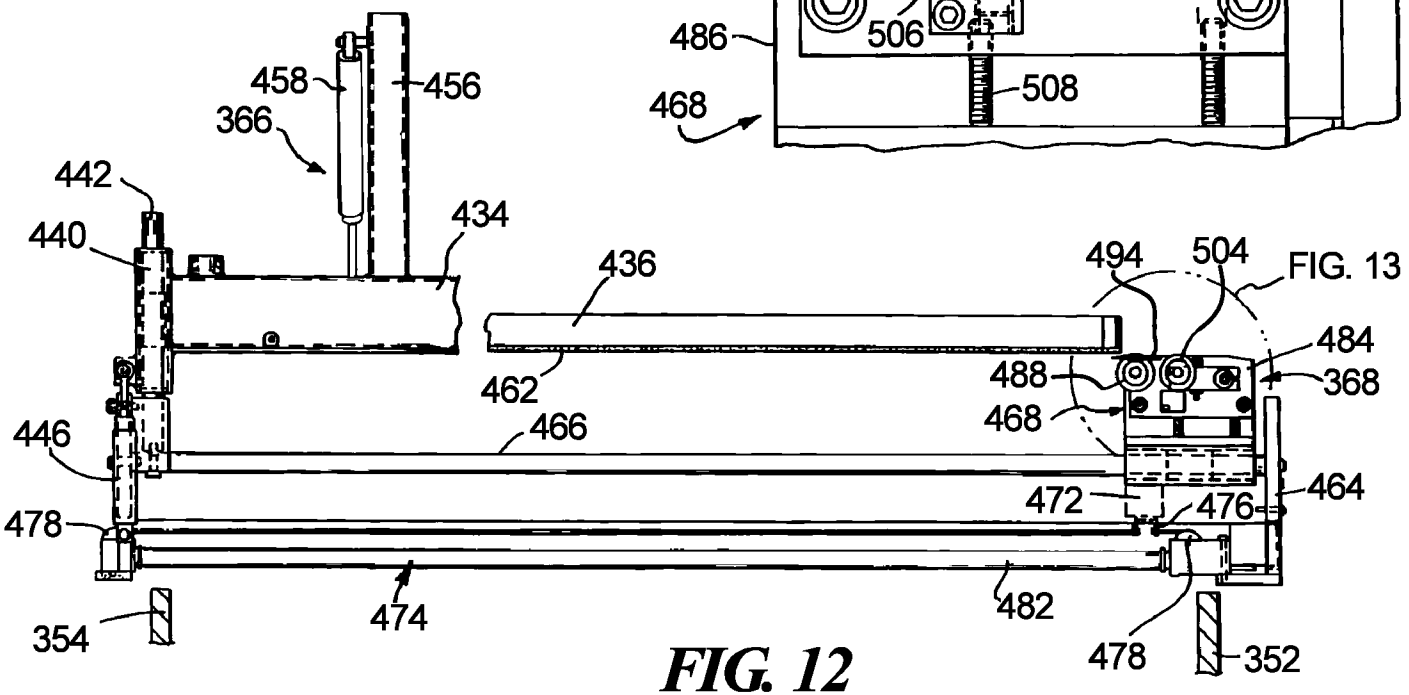
FIG. 12 is a cross-sectional view taken along the line 12-12 in FIG. 11.

Web cutting assembly 368 is best illustrated in FIGS. 12-14, and includes a pair of brackets 464 secured to the outside surfaces of side plates 352 and 354. A pair of rods 466 extend between these brackets 464 and have their ends secured to them. The longitudinal axes of rods 466 are parallel to the longitudinal axes of vacuum bars 434 and 436. Rods 466 are spaced well below the path of travel of expiring web 314.

A wheel and knife carrier subassembly 468 is mounted on rods 466 and is adapted to slide along the rods. Before a splice is initiated, this subassembly is positioned adjacent to side plate 352 as shown in FIG. 12. A block 472 depends from the lower surface of subassembly 468. The lower end of block 472 is connected with the opposite ends of a conventional cable cylinder 474 by means of a U-shaped member 476. Cable cylinder 474 includes cables that are connected with member 476 and extend around guide rollers 478 mounted at opposite ends of cylinder 482. The other ends of the cables are connected with a piston, not shown, positioned and slidable within cylinder 482. An example of such a cable cylinder is the Model No. S100-3/4-AT cylinder manufactured by Tol-O-Matic, Inc., of Minneapolis, Minn.

When cable cylinder 482 is actuated, the piston within cylinder 482 fires. This causes subassembly 468 to be moved, at a high velocity, along rods 466 and across the adjacent path of travel of expiring web 314. As best seen in FIGS. 13 and 14, wheel and knife carrier subassembly 468 includes a first, vertically disposed plate 484. The upstream facing surface of plate 484 is parallel with the longitudinal axis of rods 466. Before a splice is initiated, inwardly facing end 486 of plate 484 is disposed adjacent to the side edge of expiring web 314 as that web moves through web splicer 310.

A first wheel 488 is mounted on the upstream facing surface of plate 484 adjacent to its upper inner corner. First wheel 488 has an annular peripheral surface 489 having a width, in a direction parallel to its axis of rotation, substantially equal to one-half of the width of surface 462. First wheel 488 is adapted to rotate about an axis of rotation which is perpendicular to the plane of the upstream facing surface of plate 484. The upstream side, annular peripheral edge 490 of surface 489 of first wheel 488 is beveled and sharpened so that this annular edge serves as a rotatable knife blade. The upper portion of annular peripheral surface 489 projects slightly above the plane of the upper surface 492 of the plate. A generally "J" shaped knife member 494 is mounted on upper surface 492 of plate 484. More specifically, shorter leg 496 of "J" shaped member 494 is secured, as for example, by bolts, at the inner corner of surface 492. Longer leg 498 of member 494 has a downstream edge that is disposed closely adjacent to edge 490 of first wheel 488. The distal end of longer leg 498 projects inwardly beyond the innermost extending annular peripheral surface of wheel 488 and has a leading, chiseled edge. The distal end of leg 498 is adapted to extend between expiring web 314 and new web 324 even after assembly 366 has been moved down to its lower position.

When a splice is to be made and expiring web 314 is to be cut (that is, when subassembly 468 is to be moved rapidly across the web), the upper portion of peripheral surface 489 of first wheel 488 initially engages the adjacent end of surface 462 of vacuum bar 436. First wheel 488 is aligned so that its peripheral surface 489 only engages the downstream half of surface 462. This engagement causes the wheel to rotate in a clockwise direction as seen in FIGS. 12 and 13. As subassembly 468 and thus wheel 488 continue to move along rod 466, expiring web 314, starting with its adjacent side edge, contacts peripheral surface 489 of the rotating wheel and is cut or sheared, at a moving point of cutting defined by the cooperation between beveled edge 490 of wheel 488 and the adjacent part of the downstream facing edge of leg 498. The cut part of the trailing or downstream end of expiring web 314 (that is, the part immediately behind the moving point of cutting) moves up and over the upper portion of peripheral surface 489 of wheel 488. The cut part of upstream end of expiring web 4 drops down, by gravity, below subassembly 468 and out of the open bottom of web splicer 310. The high velocity movement of subassembly 468 across expiring web 314 rapidly cuts the web, a part at a time, from one side edge to the other.

A second, smaller plate 502 is mounted on the upstream side of plate 484 to the outside of second wheel 488. A second wheel 504 is mounted on the upstream side of this second plate. Second wheel 504 is mounted for rotation about an axis parallel to but spaced outwardly from the axis of rotation of wheel 488. Like first wheel 488, second wheel 504 has an annular peripheral surface 505 that has a width, in the direction parallel to its axis of rotation, substantially equal to one-half of the width of surface 462. Second wheel 504 is aligned so that its peripheral surface 505 only engages the upstream half of surface 462. Also like first wheel 488, the upper portion of the annular peripheral surface of second wheel 504 projects above upper edge surface 492 of plate 486. A coil compression spring 506 biases plate 502 and thus second wheel 504 upwardly. A set screw 508 is adapted to adjust the tension on spring 506 so that the upper portion of peripheral surface 505 of second wheel 504 is slightly higher than the upper portion of peripheral surface 489 of first wheel 488.

As noted, second wheel 504 is aligned so that its upper portion of its peripheral surface 505 will engage the upstream half of surface 462 of vacuum bar 436 when assembly 366 is in its lower position as shown in FIG. 19 and when the subassembly 468 moves across the path of travel of expiring web 314. When second wheel 504 first engages surface 462, second wheel 504 is forced slightly downwardly against the bias of spring 506. This causes second wheel 504 to exert a stronger line of pressure on surface 462 second wheel 504 moves across vacuum bar 436.

Web splicer 310 is configured to form a butt splice to join a leading edge of a new web to a trailing edge of an expiring web that is being fed to a continuous web processing operation using a suitable linear process, such as described above with reference to FIGS. 5 and 6, or a suitable monolithic process, such as described above with reference to FIGS. 7 and 8. In certain embodiments, the methods described herein may include a linear process or a monolithic process for forming the butt splice using an UV-curable liquid adhesive applied within a gap formed between the leading edge of the new web and the trailing edge of the expiring web, as described in detail above.

In one embodiment, as expiring web 314 runs through web splicer 310, nip assembly 362 is not actuated. New web preparation assembly 364 is in its second or downstream position, as shown in FIGS. 10 and 16, new web holding assembly 366 is in its upper position as shown in FIGS. 16 and 17, and wheel and knife carrier subassembly 468 is positioned adjacent to side plate 352. The operator feeds in the leading portion part of new web 324 around idler roll 358, past assembly 366 and back between the upper surface of anvil member 402 and the lower surface of nip bar 414 of assembly 364. The end of new web 324 may be easily threaded between anvil 402 and nip bar 414 because trimmer subassembly 416 is in its non-cutting position, as shown in FIGS. 10 and 18, due to coil extension springs, not shown, which biases it to that position. The operator then generally aligns the side edges of new web 324 with the side edges of running expiring web 314.

The operator next grasps handle 422 and moves assembly 364 forward toward its first or upstream position. When that position is reached, the operator moves handle 422 upwardly. This pivots trimmer subassembly 416 counterclockwise, about the axis of rod 398, to its cutting position and so as to hook the notches in plates 432 over locating pins 388. The rotation of trimmer subassembly 416 causes the bottom of nip bar 414 to clamp new web 324 against anvil member 402. The upstream movement of assembly 364 has additionally caused shield 406 to engage the underside of new web 324 and press a portion of new web 324 upwardly against the lower surface of vacuum bar 434. The vacuum in that bar thereafter holds this portion of new web 324 tightly against the lower surface.

The operator next slides trimmer subassembly 416 along rod 398 from one side to the other. This causes wheel 426 to move along the cutting edge of element 404. The relative movement between the cutting edge of wheel 426 and element 404 results in new web 324 being trimmed or cut. As noted, this trimmed leading end of new web 324 is aligned with and congruent with the cutting edge of element 404. The trimmed leading end of new web 324 is also spaced preselected distance downstream from the portion of new web 324 held by vacuum bar 434 due to the cooperation between pins 388 and the notches in plates 432. During this trimming of the leading end of new web 324, vacuum bar 436 remains in its first or upper position. After the leading end of new web 324 has been trimmed, assembly 364 is returned to its second or downstream position. This is done by the operator pivoting handle 422 in a clockwise direction so that the notches in plates 432 lift off locating pins 388.

Assembly 364 then moves to its second position under the bias of springs 408. When in its second position, assembly 346 is relatively remote from assemblies 366 and 368 and does not interfere with the subsequent steps in the splicing operation.

When a splice is to be initiated, the movement of expiring web 314 through web splicer 310 is brought to a stop by actuating the brakes for expiring web 314 and new web 324. The application of these brakes halts the movement of the portion of expiring web 314 in web splicer 310. Nevertheless expiring web 314, downstream from festoon 338, continues to run, without any loss of speed or tension, to the web utilization apparatus. After the portion of expiring web 314 in web splicer 310 is stopped, its lack of movement is sensed by conventional sensors, not shown, that may then initiate the splicing operation. Alternatively, the splicing operation may be initiated manually by the operator.

At the start of the splicing operation, cylinders 378 are actuated so that nip bar 376 clamps expiring web 314 against roll 332. Expiring web 314 is thus held under tension between idler roll 332 and expiring web 314. At the same time, cylinders 458 and 446 are actuated. This causes bar 436 to be rotated to its second or down position, and bars 434 and 436, and thus new web 426, to be moved downwardly to its lower position. Cable cylinder 474 is then fired resulting in wheel and knife carrier subassembly 468 being rapidly moved across expiring web 314 from one of its side edges to the other. With new web 324 moved into close proximity with expiring web 314, the distal end of leg 498 of member 494 projects between the webs to assure that the webs remain separate as subassembly 468 moves across expiring web 314.

Subassembly 468 is positioned, vis-a-vis vacuum bar 436, so that the upper portions of peripheral surfaces 489 and 505 of wheels 488 and 504 come into contact with surface 462 of bar 436 just prior to the time that wheel 488 and knife member 494 first contact the side edge of expiring web 314. Due to this initial contact with surface 462, both wheels 488 and 504 are already rotating, in a clockwise direction, by the time there first is contact between expiring web 314 and wheel 488 and knife member 494. As noted above, expiring web 314 is cut or sheared at the point where expiring web 314 contacts sharpened, beveled edge 490 of wheel 488 and the adjacent part of leg 498 of knife member 494. As a result, the point of cutting of expiring web 314 moves across the web, from one side edge to the other, as subassembly 468 moves across the web. The uncut part of expiring web 314 (that is, the part ahead of subassembly 468) remains under tension. The cut part of expiring web 314, immediately downstream from this point of cutting, rides up and over the upper portion of peripheral surface 489 of wheel 488.

In one embodiment, a butt splice is formed to join together the leading edge of new web 324 and the trailing edge of expiring web 314, as expiring web 314 runs downstream under tension along a predetermined path of travel. With both new web 324 and expiring web 314 secured, the trailing edge of expiring web 314 is registered with the leading edge of new web 324 to define a gap therebetween along a width of new web 324 and a width of expiring web 314. In one embodiment, the gap is not greater than 1 millimeter (mm); however, in alternative embodiments the gap may exceed 1 mm. With each of the leading edge and the trailing edge secured by an associated nip, for example, an adhesive applicator dispenses a controllable amount of UV-curable liquid adhesive within the gap. In certain embodiments, the adhesive applicator includes a needle applicator to facilitate accurately dispensing a desired quantity of liquid adhesive in a desired area within the gap. The adhesive applicator can be controlled using a suitable controller (not shown) to dispense a precise quantity of adhesive as the adhesive applicator moves along a length of the gap between a first lateral edge of expiring web 314 and an opposing second lateral edge of expiring web 314. A curing device is operatively coupled to the adhesive applicator such that the curing device follows the adhesive applicator along the gap to cure the adhesive dispensed in the gap. In one embodiment, the curing device includes one or more ultraviolet (UV) light sources, such as light emitting diodes (LEDs), configured to emit UV light at a suitable intensity to cure the adhesive within a desired time. In a particular embodiment, the light sources are offset with respect to a z-axis normal to a longitudinal axis to allow for better visibility of the gap and the adhesive and/or to accommodate off-gassing during the curing process, for example. In an alternative embodiment, the curing device includes one or more light sources that are fixed or stationary with respect to expiring web 314 and directed onto an area in which the adhesive is dispensed or applied such that after the adhesive applicator moves across the gap, the light sources are activated to emit UV light at a suitable intensity to cure the adhesive within a desired time. For example, a wattage output of each light source within the curing device is controllable to emit UV light at an intensity suitable to cure the adhesive within a set time. In certain embodiments, the light sources are controlled by a timer or other suitable controller (not shown) such that the light sources are activated to emit light only during the curing process. Once the adhesive is cured, a sufficiently strong butt splice is formed to join new web 324 to expiring web 314.

As soon as subassembly 468 completes its travel across expiring web 314 (that is, as soon as the leading edge of new web 324 is joined to the trailing edge of expiring web 314), the brakes for expiring web 314 and new web 324 are released, and cylinder 378 in the nip assembly is again actuated so that nip bar 376 is moved away from the periphery of idler roller 332. At the same time, cylinders 446 are actuated so as to move assembly 366 upwardly to its upper or first position. At this same time, the vacuum in bars 434 and 436 may be reduced or momentarily eliminated. The newly spliced web immediately begins to accelerate under the force of expiring web 314 being pulled through festoon 338. Thereafter, expiring web 314 is replaced by another new roll and new roll 324 is rotated to the position occupied by expiring web 314 as shown in FIG. 9. Before this occurs (that is, while running expiring web 324 is still passing around idler roll 358), subassembly 468 will return to its original position, adjacent side plate 352, so as to avoid any possibility that subassembly 468 might contact running new web 324. Preparation for another splice may then commence.

FIGS. 20A-23B illustrate several non-limiting examples of a butt splice formed in accordance with the embodiments as described herein and illustrating a front surface of the spliced webs facing the splicing assembly during the splicing process (FIGS. 20A, 21A, 22A, and 23A) and a respective opposing back surface of the spliced webs contacting a support surface of the anvil during the splicing process (FIGS. 20B, 21B, 22B, and 23B).

Several embodiments of a method are provided for forming a butt splice to join together the leading edge of a web from a new roll of material, or a new web, to the trailing edge of a web from an expiring roll of material, or an expiring web, as the expiring web runs downstream under tension along a predetermined path of travel. The butt splice is formed without any material overlap and without slowing or stopping the web-fed process, and has a strength sufficient to join the new web to the expiring web and withstand stresses and tension exerted thereon during the downstream web processing. Moreover, the embodiments allow for one or more of the following: adjusting or controlling a size of the gap defined between the new web and the expiring web, aligning and registering the leading edge of the new roll with the trailing edge of the expiring web, forming the boundaries or boarders of the butt splice, reducing or eliminating web registration errors, and reducing or eliminating undesirable adhesive leakage through the gap.

As the expiring web is unwound from the expiring roll of material, the new web is prepared and immobilized for splicing to the trailing edge of the expiring roll. The new web is cut or trimmed to form a leading edge. In one embodiment, the new web is cut or trimmed in a lateral direction from a first lateral side to an opposing second lateral side of the new web along a line substantially perpendicular to the lateral sides and a longitudinal axis of the new web. In an alternative embodiment, the new web is cut or spliced in the lateral direction along a line that is non-perpendicular to the longitudinal axis of the new web, for example extending along a line at an angle of ±5°-15° with respect to the longitudinal axis, to reduce the risk of a secondary operation impacting the splice across the full width. Similarly, as the expiring web is unwound from the expiring roll, the expiring web is cut or trimmed to form the trailing edge of the web.

In one embodiment, a splicing assembly, such as a shearing wheel or a shearing blade, is utilized for cutting the webs to form the respective leading and trailing edges. For example, in a particular embodiment, as described herein in reference to FIGS. 1-6, and particularly in reference to FIGS. 5 and 6, during a dynamic, linear process a shearing wheel is moved across a width of the web defined substantially perpendicular to a longitudinal axis of the web, to cut or splice the web. The shearing wheel may move along the width of the web along a line substantially perpendicular to a longitudinal axis of the web, transversally across a width of the web, or along a line at a non-perpendicular angle with respect to the longitudinal axis of the web. In an alternative embodiment, as described below in reference to FIGS. 1-4, 7, and 8, and particularly in reference to FIGS. 7 and 8, during a monolithic process a splicing assembly including a shearing blade is lowered onto the web to cut or splice the web. In this embodiment, the shearing blade has a length greater than the width of the web to ensure the web is entirely cut or spliced. The shearing blade may be positioned along the width of the web along a line substantially perpendicular to a longitudinal axis of the web, transversally across a width of the web, or along a line at a non-perpendicular angle with respect to the longitudinal axis of the web to provide an increased surface area to facilitate joining or splicing the webs.

The trailing edge of the expiring web is positioned with respect to the leading edge of the new roll to define a gap therebetween. In one embodiment, the new web is immobilized at or near the leading edge and the expiring web is immobilized at or near the trailing edge before or after the respective webs are cut or trimmed. In a particular embodiment, the webs are immobilized using a suitable clamp or nip to secure the webs against a support surface, such as the anvil, after the trailing edge is positioned with respect to the leading edge to define the gap.

A curable liquid adhesive, such as a suitable UV-curable liquid adhesive, is dispensed or applied within the gap between the trailing edge and the leading edge. In certain embodiments, the curable liquid adhesive is dispensed from a tube or container using a needle applicator configured to dispense the liquid adhesive at a controlled rate. The needle applicator can be adjusted to adjust an amount of liquid adhesive dispensed or applied within the gap, based at least in part on the type of materials forming the webs and properties of the materials, for example, porous nonwoven webs, non-porous paper, fiberglass, or films. The amount of adhesive dispensed, as well as the dispense time, can be adjusted and controlled to facilitate decreasing or preventing undesired oversaturation of the webs with adhesive and reducing or eliminating adhesive leakage through the gap.

After a suitable time to allow for adhesive diffusion or wicking, if desired, the liquid adhesive is cured to form the butt splice to couple the new web of material to the expiring web of material. In certain embodiments utilizing a UV-curable liquid adhesive, one or more UV light sources, such as one or more UV-curing light emitting diodes (LEDs), emit a light having a controllable UV-curing intensity to cure the liquid adhesive in a suitable time period. In certain embodiments, the one or more light sources are positioned substantially perpendicular to a surface of the web. Alternatively, the one or more light sources may be offset with respect to a z-axis of the surface of the web, i.e., at a non-perpendicular angle with respect to the surface of the web, to allow for better visibility of the gap and dispensed adhesive and/or to accommodate off-gassing during the curing process, for example. Further, in one embodiment, the one or more light sources are operatively coupled to the splicing assembly such that the light sources move with the splicing assembly, as described herein. For example, in a particular embodiment one or more light sources are moved along a length of the gap to emit a UV light to cure the liquid adhesive. Alternatively, the light sources can be fixed or stationary with respect to the anvil and directed onto an area of the gap in which the curable liquid adhesive is dispensed or applied to cure the adhesive. Additionally, the light sources may be controlled by a timer or other suitable controller such that the light sources emit UV-curing light only during the curing process.

Referring further to FIGS. 5 and 6, in one embodiment, a method is disclosed for forming a butt splice to join together the leading edge of the new web and the trailing edge of the expiring web, as the expiring web runs downstream under tension along a predetermined path of travel. As shown in FIGS. 5 and 6, a leading edge 102 is formed on a new web of material 104 by trimming or cutting the new web 104. Once new web 104 is trimmed or cut, new web 104 is temporarily secured against a surface of an anvil 106 using nip 40 or a clamp to facilitate joining new web 104 to an expiring web 110. With leading edge 102 secured against anvil 106, expiring web 110 is temporarily secured against anvil 30 using nip 41 or a clamp. With both new web 104 and expiring web 110 secured to anvil 30, splicing assembly 135 is moved laterally across a width of expiring web 110. Splicing assembly 135 includes a shear wheel 116, an adhesive applicator 118, and a curing device 120 including one or more UV-curing light sources. As splicing assembly 135 moves across expiring web 110, shear wheel 116 cuts or trims expiring web 110 to form a trailing edge 122. Trailing edge 122 is registered with leading edge 102 to define a gap 124 between leading edge 102 and trailing edge 122 along a width of new web 104 and a width of expiring web 110. With each of leading edge 102 and trailing edge 122 secured to anvil 30, adhesive applicator 118 dispenses a controllable amount of UV-curable, liquid adhesive 126 within gap 124.

In certain embodiments, adhesive applicator 118 includes a needle applicator to facilitate accurately dispensing a desired quantity of liquid adhesive in a desired area within gap 124. As shown in FIG. 5, adhesive applicator 118 is operatively coupled to shear wheel 116 such that adhesive applicator 118 moves across expiring web 110 with shear wheel 116. Adhesive applicator 118 is controlled using a suitable controller to dispense a precise quantity of adhesive as adhesive applicator 118 moves along a length of gap 124 between a first lateral edge 128 of expiring web 110, substantially parallel to a longitudinal axis 130 of expiring web 110, and an opposing second lateral edge 132 of expiring web 110, as shown in FIG. 5.

Curing device 120 is operatively coupled to adhesive applicator 118 such that curing device 120 follows adhesive applicator 118 along gap 124 to cure adhesive 126 dispensed in gap 124. In one embodiment, curing device 120 includes one or more ultraviolet (UV) light sources 134 as shown in FIG. 6, such as LEDs, configured to emit UV light at a suitable intensity to cure adhesive 126 within a desired time. In a particular embodiment, light sources 134 are offset with respect to a z-axis 134 normal to longitudinal axis 128, as shown in FIG. 6, to allow for better visibility of gap 124 and adhesive 126 and/or to accommodate off-gassing during the curing process, for example. In an alternative embodiment, curing device 120 includes one or more light sources 134 that are fixed or stationary with respect to expiring web 110 and directed onto an area in which adhesive 126 is dispensed or applied such that after adhesive applicator 118 moves across gap 124, light sources 134 are activated to emit UV light at a suitable intensity to cure adhesive 126 within a desired time. For example, a wattage output of each light source 134 within curing device 120 is controllable to emit UV light at an intensity suitable to cure adhesive 126 within a set time. In this embodiment, light sources 134 may also be controlled by a timer or other suitable controller such that light sources 134 are activated to emit light only during the curing process. Once adhesive 126 is cured, a strong butt splice 140 is formed, as shown in FIG. 6, to join new web 104 to expiring web 110. Nips 40, 41 are then released to allow the joined webs to move downstream.

Referring further to FIGS. 7 and 8, in an alternative embodiment, a method is disclosed for forming a butt splice to join the leading edge of the new web to the trailing edge of the expiring web, as the expiring web runs downstream under tension along a predetermined path of travel. As shown in FIGS. 7 and 8, leading edge 102 is formed on new web of material 104 by cutting or trimming new web 104. Once new web 104 is cut or trimmed, new web 104 is temporarily secured against anvil 30 by nip 40 or a clamp, as shown in FIG. 8, to facilitate joining new web 104 to expiring web 110. With leading edge 102 secured against anvil 30, in one embodiment, expiring web 110 is temporarily secured against anvil 30 by nip 41 or a clamp 212. With both new web 104 and expiring web 110 secured to anvil 30, a splicing assembly 235 is moved, such as by a vertical gravity drop, towards a surface of expiring web 110 registered with new web 104. Splicing assembly 235 includes a shear blade 216 and an adhesive applicator manifold 218. In one embodiment, a curing device 220, including one or more UV-curing light sources 222 as shown in FIG. 8, is positioned with respect to a support surface of anvil 30 on which each of new web 104 at leading edge 102 and expiring web 110 at trailing edge 122 is supported. As splicing assembly 235 moves through expiring web 110, shear blade 216 cuts or trims expiring web 110 to form trailing edge 122. Trailing edge 122 is registered with leading edge 102 to define gap 124 between leading edge 102 and trailing edge 122 along a width of new web 104 and a width of expiring web 110.

As shearing blade 216 passes through expiring web 110, one or more stops 224, shown in FIG. 7, are positioned under anvil 30 to stop or prevent further movement of shearing blade 216 and facilitate accurately positioning adhesive applicator manifold 218 over gap 124 defined between leading edge 102 and trailing edge 122. With each of leading edge 102 and trailing edge 122 immobilized, adhesive applicator manifold 218 dispenses a controllable amount of UV-curable, liquid adhesive 126 within gap 124. In certain embodiments, adhesive applicator manifold 218 includes one or more needle applicators to facilitate accurately dispensing a desired quantity of liquid adhesive in a desired area within gap 124. Adhesive applicator manifold 218 is controlled using a suitable controller (not shown) to dispense a precise quantity of adhesive as adhesive applicator manifold 218 is positioned over a length of gap 124 between a first lateral edge 128 of expiring web 110 and second lateral edge 132 of expiring web 110.

As shown in FIG. 8, curing device 220 includes one or more UV-curing light sources 222 positioned on opposing lateral sides of gap 124. In this embodiment, each light source 222 is fixed or stationary with respect to expiring web 110 and directed onto an area in which adhesive 126 is dispensed or applied such that after adhesive applicator manifold 218 dispenses adhesive 126 and is retracted upward to an initial position, light sources 222 are activated to emit UV light at a suitable intensity to cure adhesive 126 within a desired time. For example, a wattage output of each light source 222 within curing device 220 is controllable to emit UV light at an intensity suitable to cure adhesive 126 within a set time. In this embodiment, light sources 222 may also be controlled by a timer or other suitable controller such that light sources 222 are activated to emit light only during the curing process. In one embodiment, curing device 220 includes one or more UV light sources 222 as shown in FIG. 8, such as LEDs, configured to emit UV light at a suitable intensity to cure adhesive 126 within a desired time. In a particular embodiment, light sources 222 are offset with respect to z-axis 134 normal to longitudinal axis 128, as shown in FIG. 8, to allow for better visibility of gap 124 and adhesive 126 and/or to accommodate off-gassing during the curing process, for example. In alternative embodiments, curing device 220 is operatively coupled to splicing assembly 235 such that curing device 220 follows adhesive applicator manifold 218 towards gap 124 to cure adhesive 126 dispensed in gap 124.

Once adhesive 126 is cured, a sufficiently strong butt splice 140 is formed to join new web 104 to expiring web 110. Nips 40, 41 are then released to allow the joined webs to move downstream.

The described apparatus and methods are not limited to the specific embodiments described herein. In addition, components of each apparatus and/or steps of each method may be practiced independently and separately from other components and method steps, respectively, described herein. Each component and method also can be used in combination with other systems, apparatus, and methods.

This written description uses examples to disclose the embodiments, including the best mode, and also to enable any person skilled in the art to practice the embodiments, including making and using any devices or systems and performing any incorporated methods.

What is claimed is:

1. A method for forming a butt splice to join a first web of material to a second web of material, comprising:

cutting a first web of material to form a first edge;

cutting a second web of material to form a second edge, the cutting being performed by a cutting, adhesive applying and curing apparatus, the second edge positioned with respect to and registered with the first edge to define a gap between the first edge and the second edge;

applying a curable adhesive within the gap, the applying the curable adhesive being performed by the cutting, adhesive applying and curing apparatus, the curable adhesive being applied only within the gap so as to provide a splice having a same thickness as each of the first and second webs; and curing the curable adhesive to form a butt splice that joins the first web of material to the second web of material, the curing being performed by the cutting, adhesive applying and curing apparatus.

2. The method of claim 1, wherein the curable adhesive is a curable liquid adhesive.

3. The method of claim 1, wherein the curable adhesive is a UV-curable adhesive.

4. The method of claim 3, wherein the UV-curable adhesive is cured using one or more UV light sources.

5. The method of claim 1, wherein the material of the first web and the material of the second web is selected from the group of material consisting of film, coated film or material, fiber, fiberglass, paper including cardboard, nonwoven web, woven web, and combinations thereof.

6. The method of claim 1, further comprising: processing the web in a continuous web processing operation; and temporarily immobilizing a portion of the first web of material and a portion of the second web of material during the cutting of the second web and during the applying of the curable adhesive and during the curing of the curable adhesive.

7. The method of claim 1, wherein the cutting of the first web of material and the cutting of the second web of material includes cutting the webs in a lateral direction from a first lateral side to an opposing second lateral side of the respective first and second webs along a line substantially perpendicular to the lateral sides and a longitudinal axis of the respective first and second webs.

8. The method of claim 1, wherein the second web of material is cut in the lateral direction along a line that is non-perpendicular to the longitudinal axis of the second web.

9. The method of claim 1, wherein the method is performed by a web splicer configured for a continuous web processing operation.

10. The method of claim 9, wherein the web splicer comprises an unwind stand, the cutting, adhesive applying and curing apparatus, and a storage festoon.

11. The method of claim 10, wherein the unwind stand comprises at least one spindle and at least one idler roller for each spindle.

12. The method of claim 10, wherein the cutting, adhesive applying and curing apparatus includes a shear assembly, an adhesive applicator, and a curing device including one or more UV-curing light sources all mounted on a chassis for movement laterally of the web.

13. The method of claim 1, wherein the cutting of the second web includes moving a cutting blade in a direction from a first lateral side of the second web to the second lateral side of the second web, the moving of the cutting blade also moving an adhesive dispenser that performs the applying of the curable adhesive, the moving of the cutting blade also moving at least one light source that performs the curing.

14. The method as claimed in claim 1, wherein the cutting and adhesive applying and curing apparatus is monolithic.

15. The method as claimed in claim 1, wherein the cutting is performed by a cutting blade that is mounted for movement in a direction perpendicular to a surface of the second web, and wherein the applying of the adhesive is performed by an adhesive applying apparatus that moves with the cutting blade.

16. The method as claimed in claim 1, wherein the applying of the adhesive is performed by an adhesive applicator that is operatively connected to at least one of a shear blade that performs the cutting of at least one of the first and second webs and a curing device that performs the curing of the adhesive.

17. A method for forming a butt splice to join together a leading edge of a new web of material and a trailing edge of an expiring web of material as the expiring web runs downstream under tension along a predetermined path of travel, wherein the butt splice is formed using a web splicer configured for a continuous web processing operation, said method comprising:

securing the new web;

securing the expiring web;

registering the leading edge of the new web with the trailing edge of the expiring web to define a gap between the leading edge and the trailing edge along a width of new web and a width of expiring web;

dispensing a controllable amount of UV-curable liquid adhesive using an adhesive dispensing and curing apparatus, the dispensing supplying the UV-curable liquid adhesive only in the gap between the new and expiring webs so that a splice is formed without increasing a thickness of the web at the splice; and curing the UV-curable liquid adhesive using the adhesive dispensing and curing apparatus to form a bond between the new and expiring webs at the splice.

18. The method of claim 17, wherein the gap measures less than 2millimeters in a longitudinal direction of the web between a point on the leading edge of the new web and its aligned point on the trailing edge of the expiring web.

19. The method of claim 17, wherein the gap measures less than 1millimeter in a longitudinal direction of the web between a point on the leading edge of the new web and its aligned point on the trailing edge of the expiring web.

20. The method of claim 17, wherein the material is selected from the group consisting of film, coated film or material, fiber, fiberglass, paper including cardboard, nonwoven web, woven web, and combinations thereof.

21. The method of claim 17, wherein the curing includes directing one or more UV light sources on to the UV-curable liquid adhesive.

22. The method of claim 17, wherein the web splicer comprises an unwind stand, the adhesive dispensing and curing apparatus, a storage festoon, and an anvil positioned substantially parallel to end members of a splicer frame, wherein the adhesive dispensing and curing apparatus includes an adhesive dispenser and a curing apparatus operatively connected to one another.

23. The method of claim 22, wherein the unwind stand comprises at least one spindle and at least one idler roller for each spindle.

24. The method of claim 22, wherein the adhesive dispensing and curing apparatus includes a shear wheel, an adhesive applicator, and a curing device including one or more UV-curing light sources, wherein at least the shear wheel and the adhesive applicator are operatively connected to one another.

* * * * *